US006920902B2

(12) United States Patent
Majaury et al.

(10) Patent No.: US 6,920,902 B2
(45) Date of Patent: Jul. 26, 2005

(54) MULTI-LAYER FABRIC

(75) Inventors: Brian G. Majaury, Perth (CA); Ernest Fahrer, Kintzheim (FR); Monique Fagon, Erstein (FR); Rita Hansson, Halmstad (SE)

(73) Assignee: Albany International Corp., Albany, NY (US)

( * ) Notice: Subject to any disclaimer, the term of this patent is extended or adjusted under 35 U.S.C. 154(b) by 239 days.

(21) Appl. No.: 10/411,235

(22) Filed: Apr. 10, 2003

(65) Prior Publication Data

US 2004/0154683 A1 Aug. 12, 2004

Related U.S. Application Data

(63) Continuation-in-part of application No. 10/334,166, filed on Dec. 30, 2002.

(51) Int. Cl.[7] ..... D03D 13/00

(52) U.S. Cl. ..... 139/383 A; 442/203; 442/205; 162/900; 162/902; 162/903

(58) Field of Search ..... 139/383 R, 383 A; 442/203, 205; 162/900, 902, 903

(56) References Cited

U.S. PATENT DOCUMENTS

| | | | | |
|---|---|---|---|---|
| 4,314,589 A | | 2/1982 | Buchanan et al. | 139/383 |
| 4,501,303 A | | 2/1985 | Osterberg | 139/425 |
| 5,013,330 A | * | 5/1991 | Durkin et al. | 51/297 |
| 5,151,316 A | * | 9/1992 | Durkin et al. | 428/213 |
| 5,152,326 A | | 10/1992 | Vohringer | |
| 5,507,915 A | * | 4/1996 | Durkin et al. | 162/117 |
| 5,709,205 A | | 1/1998 | Bukta | 128/633 |
| 5,826,627 A | | 10/1998 | Seabrook et al. | 139/383 |
| 5,881,704 A | | 3/1999 | Andrews | 124/23.1 |
| 5,917,185 A | | 6/1999 | Yeung et al. | 250/288 |
| 5,937,914 A | | 8/1999 | Wilson | 139/383 |
| 5,944,062 A | | 8/1999 | Gampe | 139/383 |
| 5,967,185 A | | 10/1999 | Baruschke et al. | 137/625.29 |
| 5,967,195 A | | 10/1999 | Ward | 139/383 |
| 6,145,550 A | | 11/2000 | Ward | 139/383 |
| 6,202,705 B1 | * | 3/2001 | Johnson et al. | 139/383 A |
| 6,207,598 B1 | | 3/2001 | Lee et al. | 442/206 |
| 6,240,973 B1 | | 6/2001 | Stone et al. | 139/383 |
| 6,276,402 B1 | | 8/2001 | Herring | 139/383 |
| 6,581,645 B1 | * | 6/2003 | Johnson et al. | 139/383 A |
| 2003/0010393 A1 | | 1/2003 | Kuji | |

FOREIGN PATENT DOCUMENTS

| | | |
|---|---|---|
| CA | 2352898 A | 10/2001 |

* cited by examiner

*Primary Examiner*—John J. Calvert
*Assistant Examiner*—Robert H. Muromoto
(74) *Attorney, Agent, or Firm*—Frommer Lawrence & Haug LLP; Ronald R. Santucci

(57) ABSTRACT

A fabric having top and bottom layers, with each layer having machine direction (MD) yarns and cross-direction (CD) yarns interwoven together. The fabric includes pairs of binder yarns that bind together the top and bottom layers. The binder pairs are interwoven so as to be an integral part of the first layer and contribute to a structure thereof. The binder pairs are a non-integral part of the second layer and do not contribute to a structure thereof. During a repeat pattern, at least one of the two binder yarns of a binder pair is integrally woven with the yarns of the first layer and passes over outer surfaces of two non-consecutive yarns in the second layer. As a result, a "double knuckle" binding structure may be formed which improves integrity of the resulting composite fabric by reducing the length of the binder yarn path through the fabric.

27 Claims, 27 Drawing Sheets

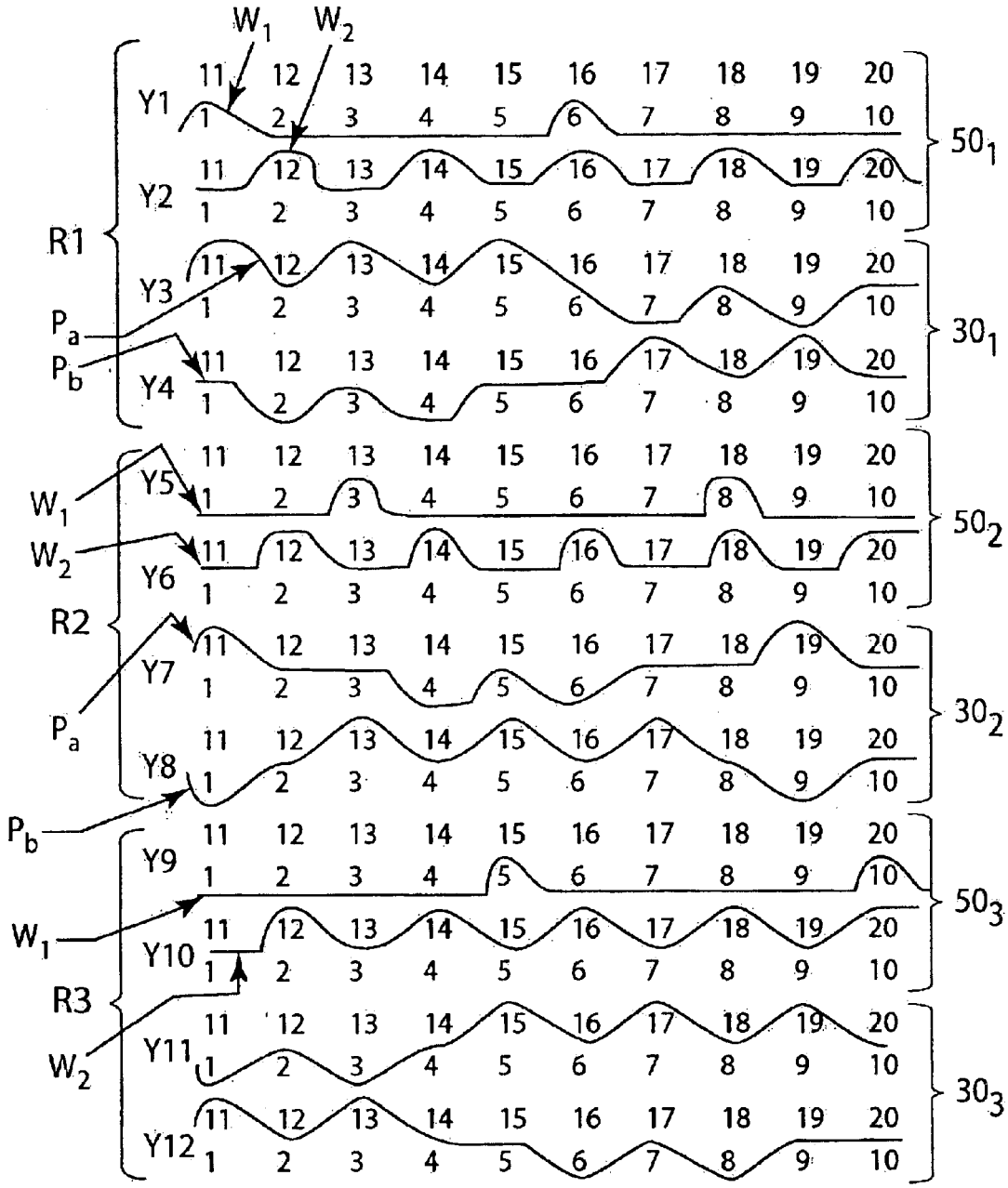
FIG. 7A
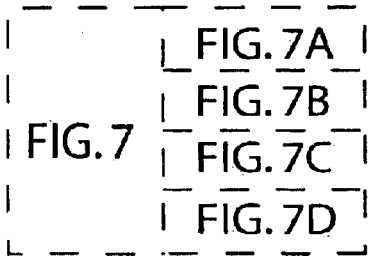

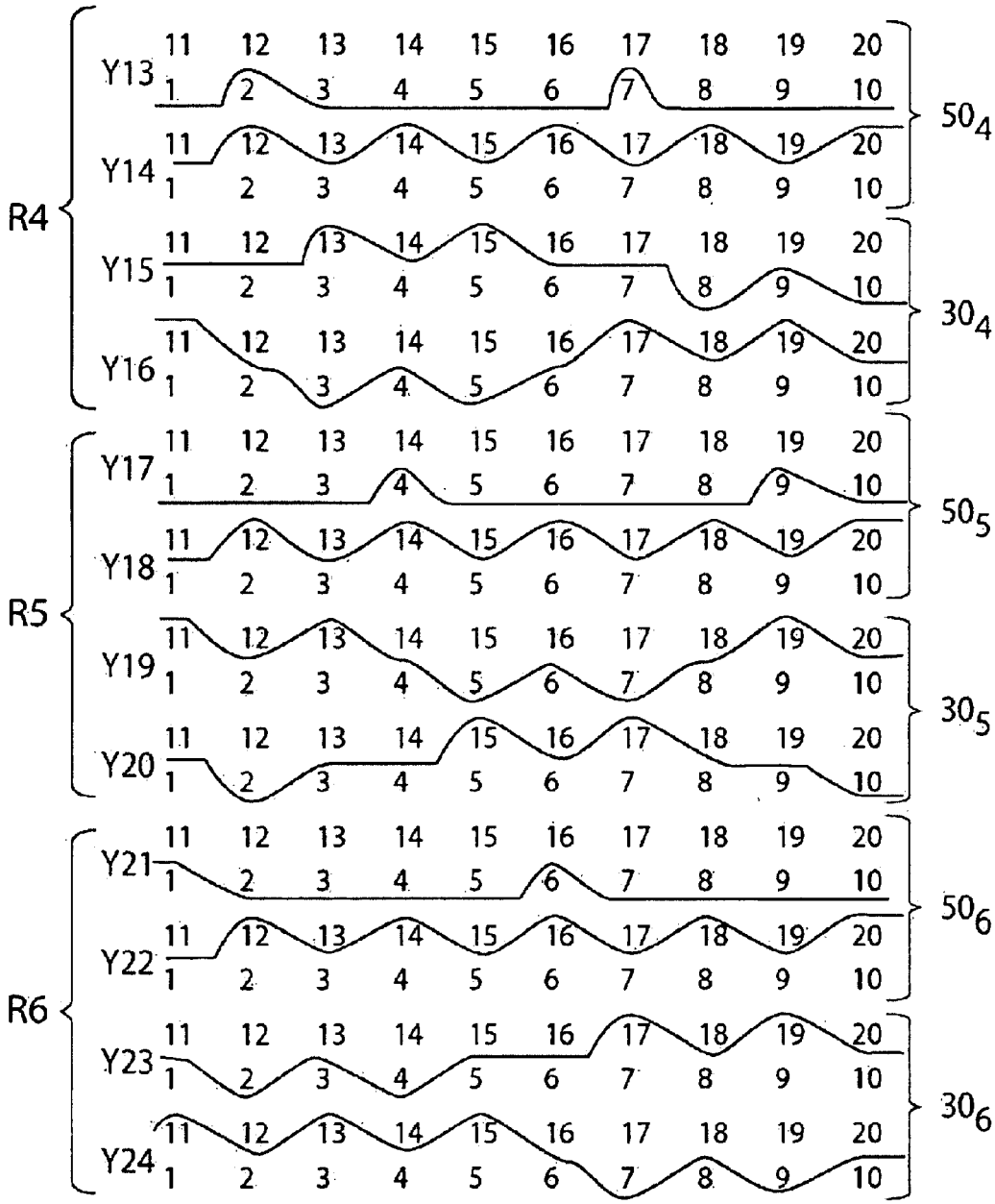
FIG. 7B
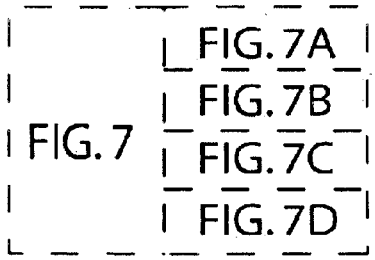

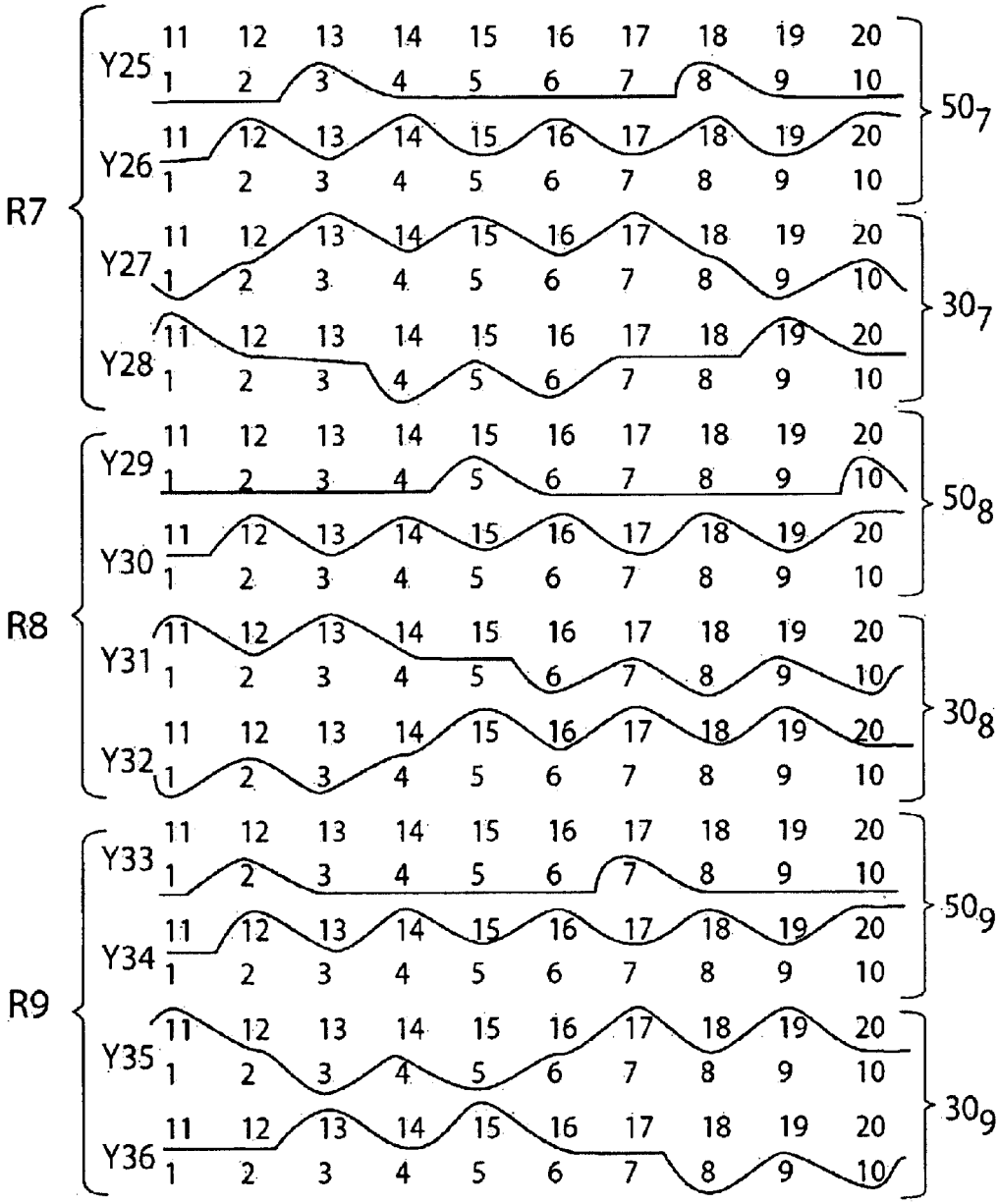
FIG. 7C
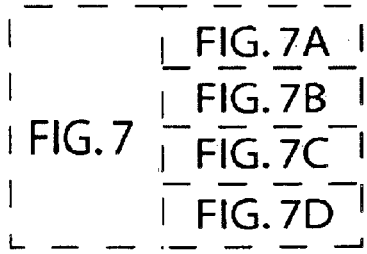

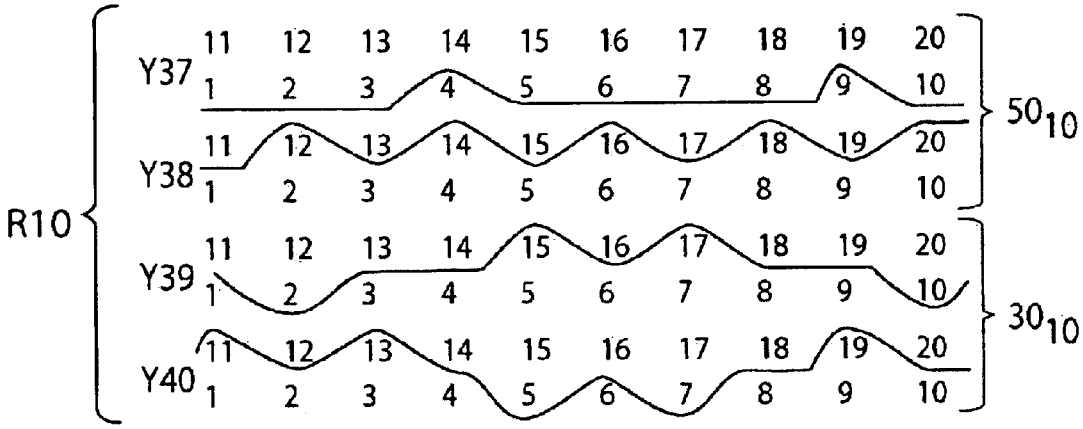
FIG. 7D
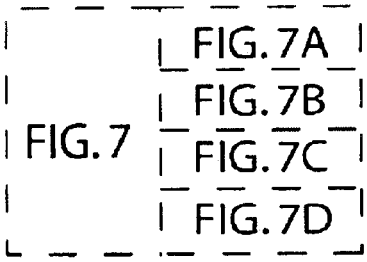

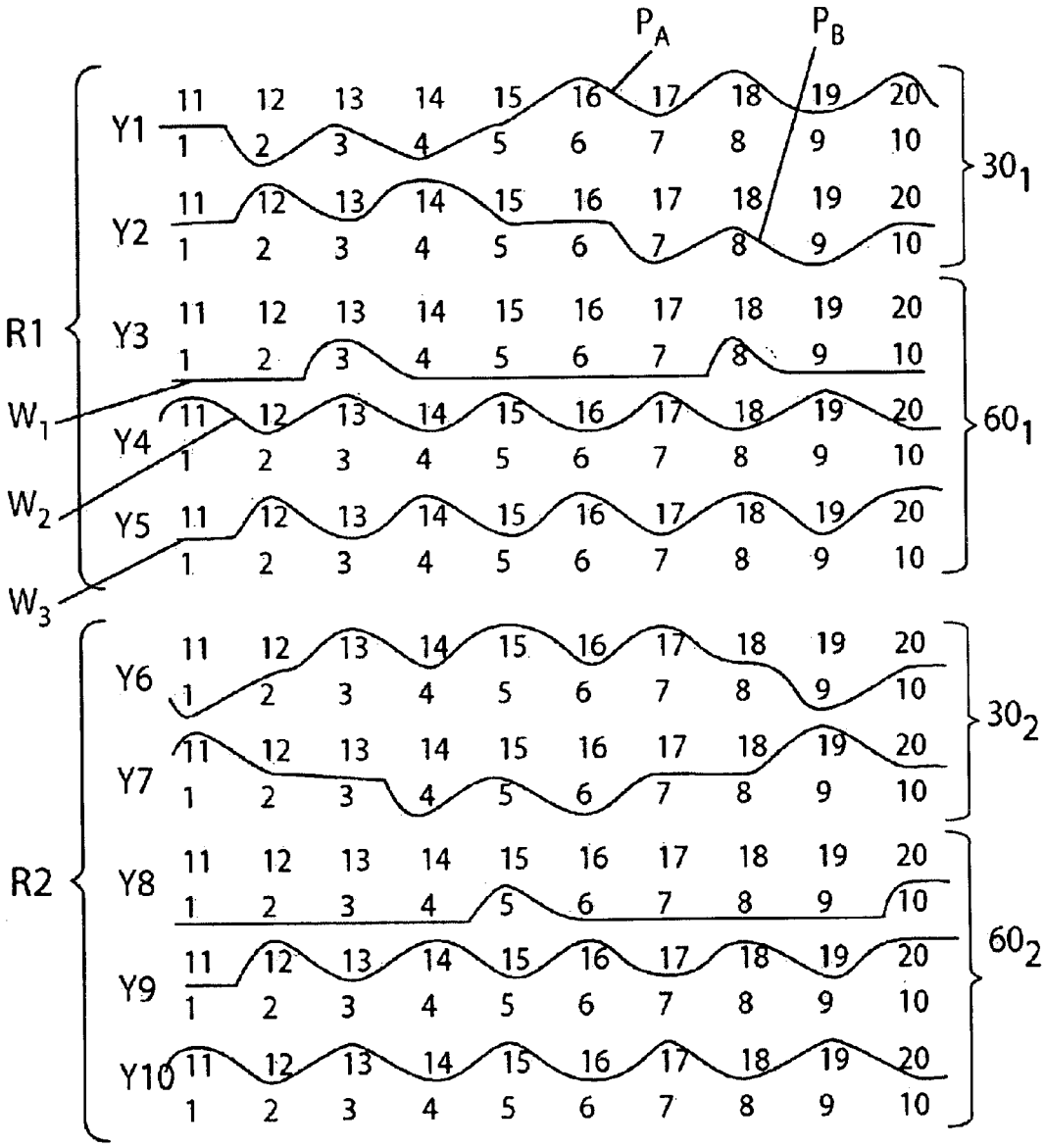
FIG. 8A
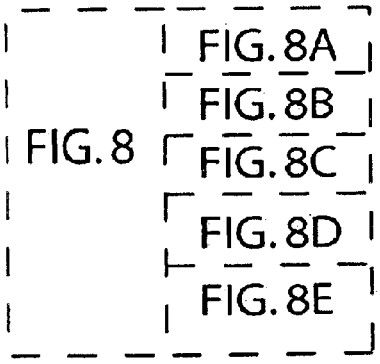

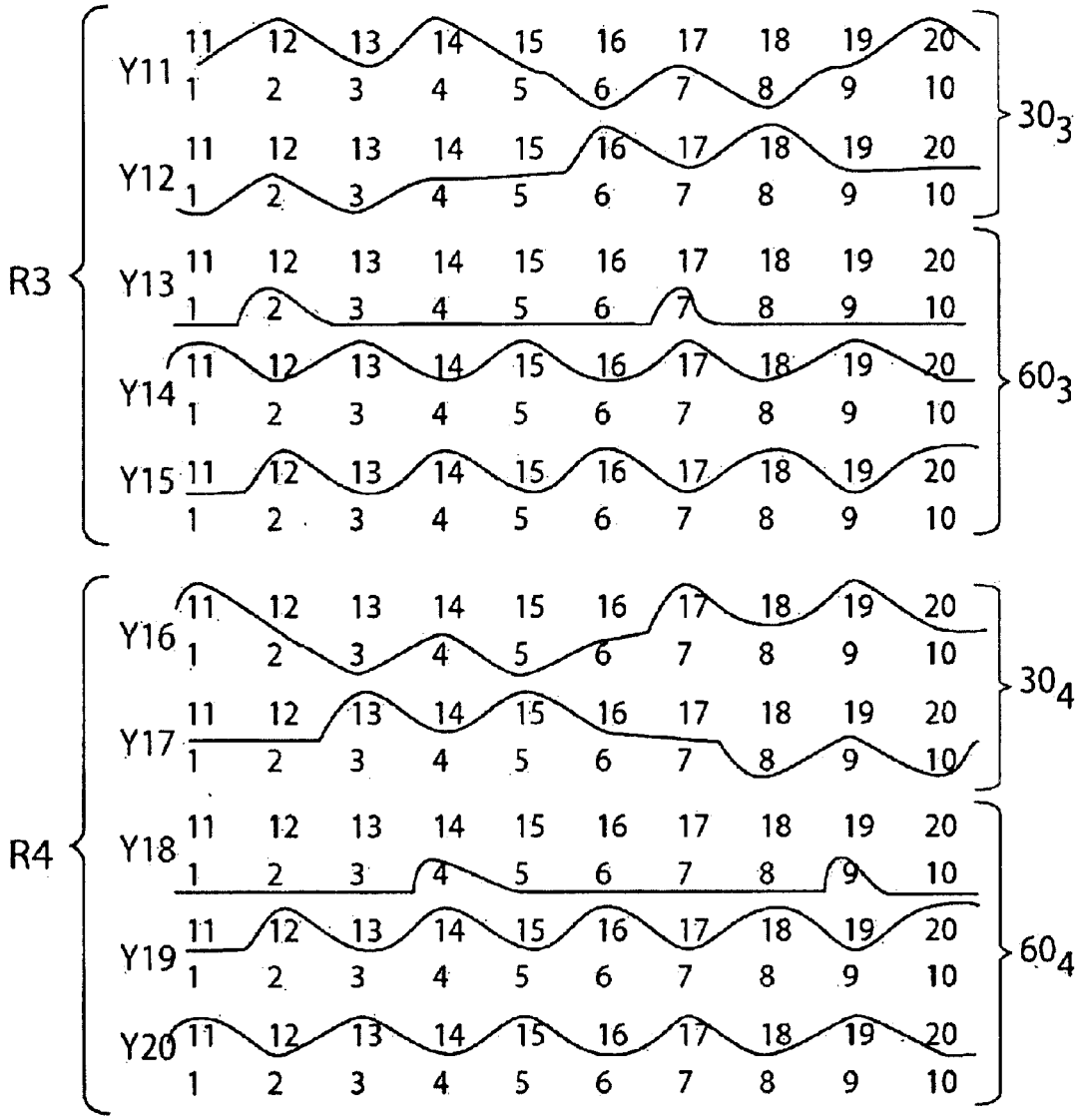
FIG. 8B
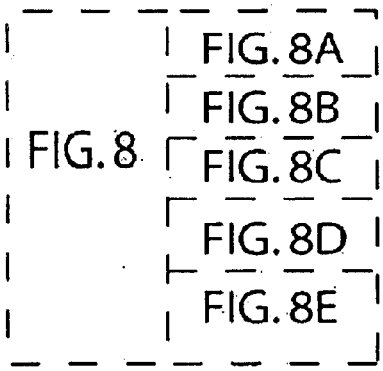

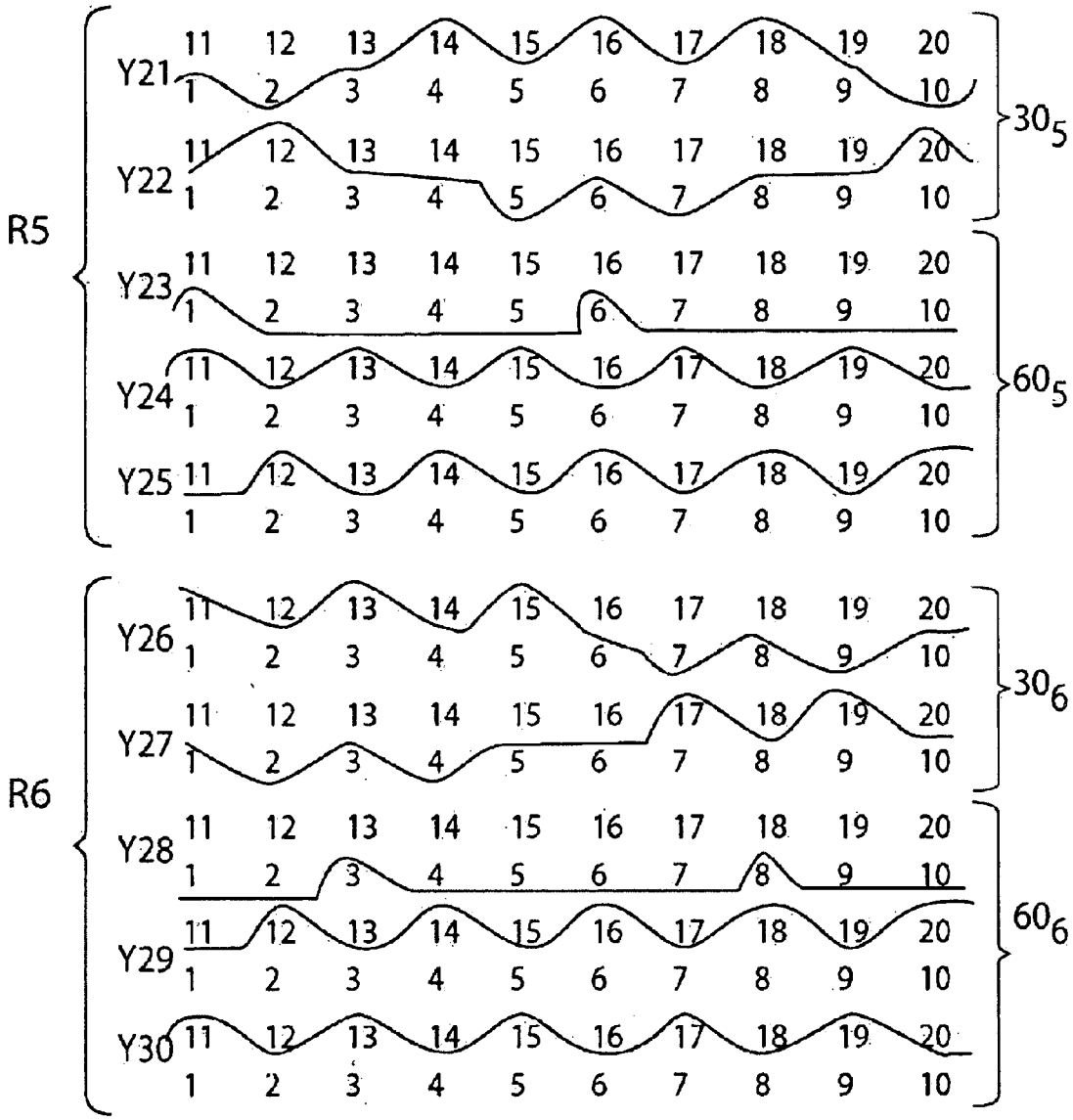
FIG. 8C
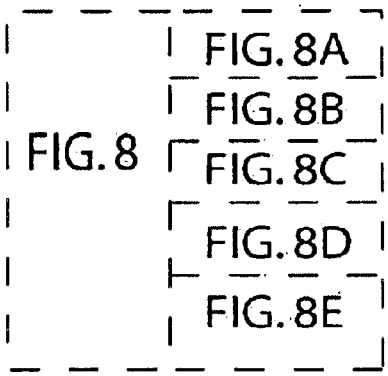

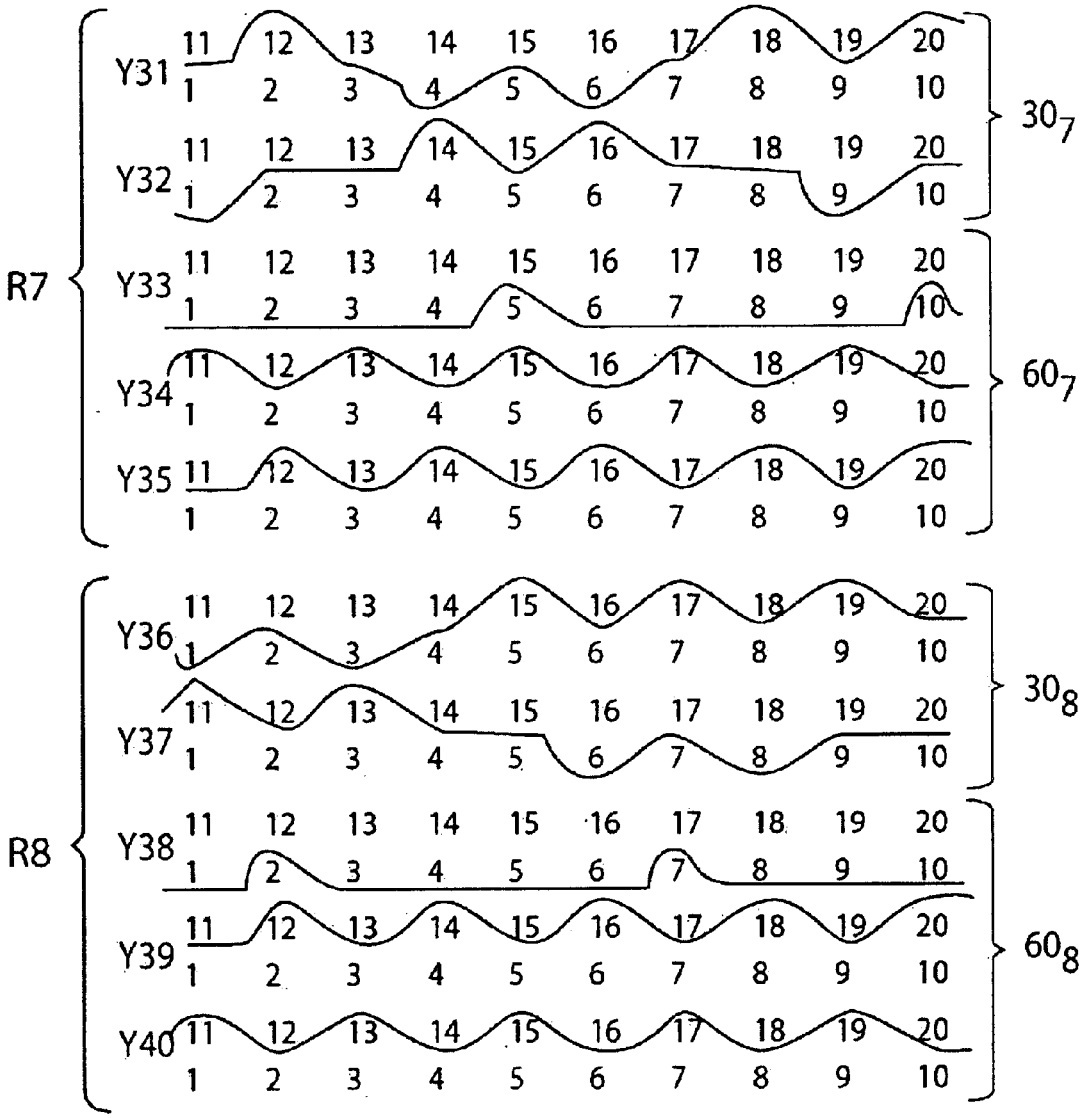
FIG. 8D
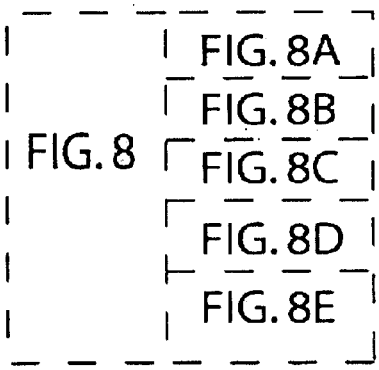

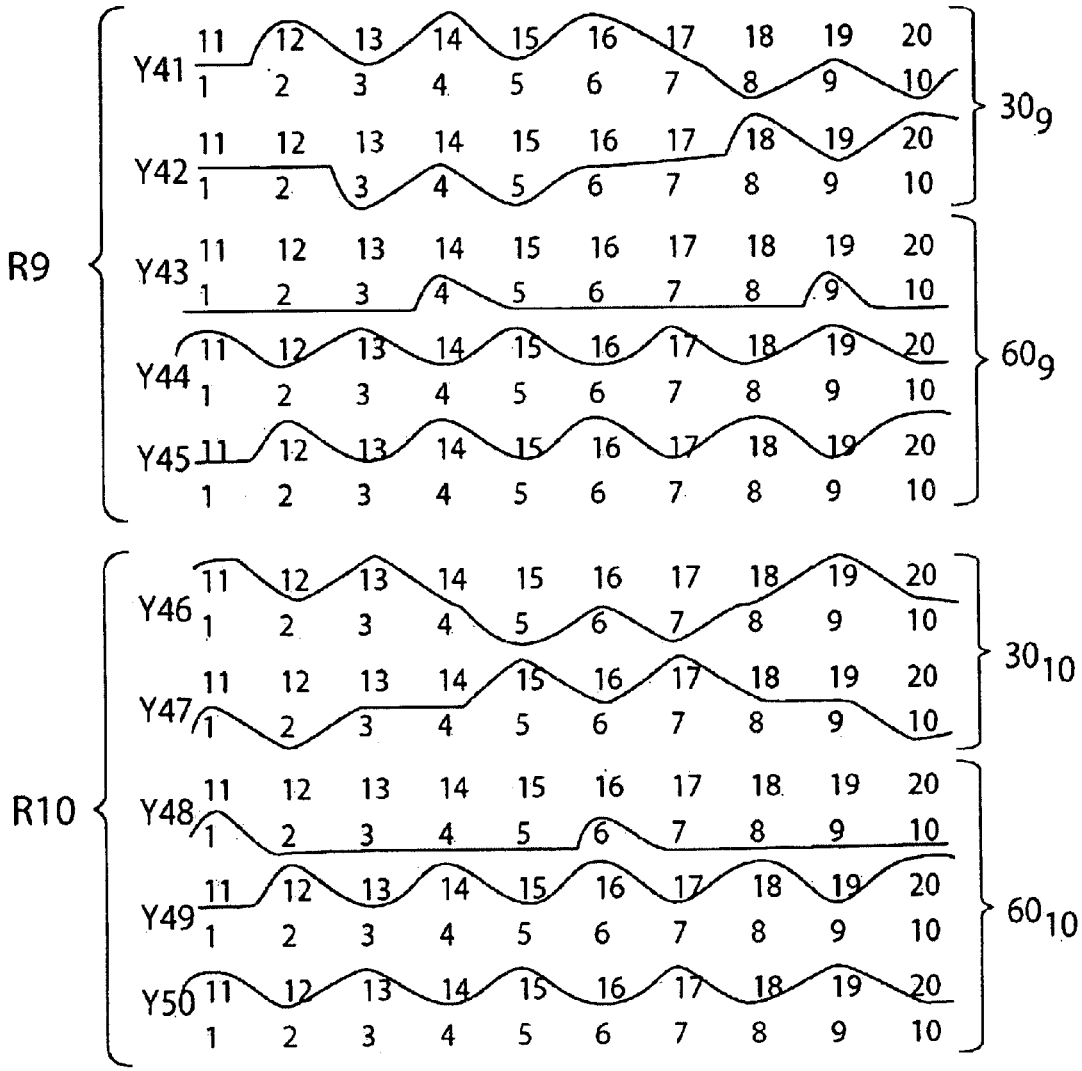
FIG. 8E
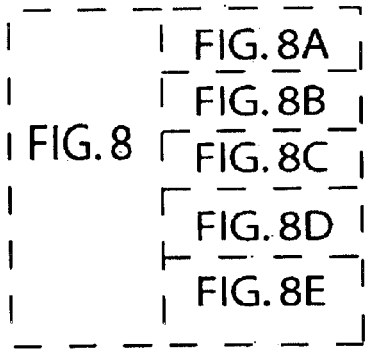

| | | | | | | | | | | | | | | | | | | | | |
|---|---|---|---|---|---|---|---|---|---|---|---|---|---|---|---|---|---|---|---|---|
| 1 | | 2 | 3 | 4 | 5 | 6 | | 8 | | 10 | | | | 14 | | | | | | |
| 2 | | 2 | | 4 | | 6 | | 8 | 9 | 10 | | | | | | | | | 19 | |
| 3 | 1 | 2 | 3 | 4 | 5 | 6 | 7 | 8 | 9 | 10 | 11 | 12 | | 14 | 15 | 16 | 17 | | 19 | 20 |
| 4 | 1 | | 3 | | 5 | | 7 | | 9 | | | | | | | | | | | |
| 5 | | 2 | | 4 | | 6 | 7 | 8 | | 10 | | | | | | | 17 | | | |
| 6 | 1 | 2 | 3 | 4 | | 6 | | 8 | | 10 | | 12 | | | | | | | | |
| 7 | 1 | 2 | 3 | 4 | 5 | 6 | 7 | 8 | 9 | 10 | | 12 | 13 | 14 | 15 | | 17 | 18 | 19 | 20 |
| 8 | 1 | | 3 | | 5 | | 7 | | 9 | | | | | | | | | | | |
| 9 | 1 | 2 | | 4 | | 6 | | 8 | 9 | 10 | | | | | | | | | | 20 |
| 10 | | 2 | | 4 | 5 | 6 | | 8 | | 10 | | | | | 15 | | | | | |
| 11 | 1 | 2 | 3 | 4 | 5 | 6 | 7 | 8 | 9 | 10 | 11 | 12 | 13 | | 15 | 16 | 17 | 18 | | 20 |
| 12 | 1 | | 3 | | 5 | | 7 | | 9 | | | | | | | | | | | |
| 13 | | 2 | 3 | 4 | | 6 | | 8 | | 10 | | | 13 | | | | | | | |
| 14 | | 2 | | 4 | | 6 | 7 | 8 | 9 | 10 | | | | | | | | 18 | | |
| 15 | 1 | 2 | 3 | 4 | 5 | 6 | 7 | 8 | 9 | 10 | 11 | | 13 | 14 | 15 | 16 | | 18 | 19 | 20 |
| 16 | 1 | | 3 | | 5 | | 7 | | 9 | | | | | | | | | | | |
| 17 | | 2 | | 4 | 5 | 6 | 7 | 8 | | 10 | | | | | | 16 | | | | |
| 18 | 1 | 2 | | 4 | | 6 | | 8 | | 10 | 11 | | | | | | | | | |
| 19 | 1 | 2 | 3 | 4 | 5 | 6 | 7 | 8 | 9 | 10 | 11 | 12 | 13 | 14 | | 16 | 17 | 18 | 19 | |
| 20 | 1 | | 3 | | 5 | | 7 | | 9 | | | | | | | | | | | |
| 21 | | 2 | | 4 | | 6 | | 8 | 9 | 10 | | | | | | | | | 19 | |
| 22 | | 2 | 3 | 4 | 5 | 6 | | 8 | | 10 | | | | 14 | | | | | | |
| 23 | 1 | 2 | 3 | 4 | 5 | 6 | 7 | 8 | 9 | 10 | 11 | 12 | | 14 | 15 | 16 | 17 | | 19 | 20 |
| 24 | 1 | | 3 | | 5 | | 7 | | 9 | | | | | | | | | | | |
| 25 | 1 | 2 | 3 | 4 | | 6 | | 8 | | 10 | | 12 | | | | | | | | |
| 26 | | 2 | | 4 | | 6 | 7 | 8 | | 10 | | | | | | | 17 | | | |
| 27 | 1 | 2 | 3 | 4 | 5 | 6 | 7 | 8 | 9 | 10 | | 12 | 13 | 14 | 15 | | 17 | 18 | 19 | 20 |
| 28 | 1 | | 3 | | 5 | | 7 | | 9 | | | | | | | | | | | |
| 29 | | 2 | | 4 | 5 | 6 | | 8 | | 10 | | | | | 15 | | | | | |
| 30 | 1 | 2 | | 4 | | 6 | | 8 | 9 | 10 | | | | | | | | | | 20 |
| 31 | 1 | 2 | 3 | 4 | 5 | 6 | 7 | 8 | 9 | 10 | 11 | 12 | 13 | | 15 | 16 | 17 | 18 | | 20 |
| 32 | 1 | | 3 | | 5 | | 7 | | 9 | | | | | | | | | | | |
| 33 | | 2 | | 4 | | 6 | 7 | 8 | 9 | 10 | | | | | | | | 18 | | |
| 34 | | 2 | 3 | 4 | | 6 | | 8 | | 10 | | | 13 | | | | | | | |
| 35 | 1 | 2 | 3 | 4 | 5 | 6 | 7 | 8 | 9 | 10 | 11 | | 13 | 14 | 15 | 16 | | 18 | 19 | 20 |
| 36 | 1 | | 3 | | 5 | | 7 | | 9 | | | | | | | | | | | |
| 37 | 1 | 2 | | 4 | | 6 | | 8 | | 10 | 11 | | | | | | | | | |
| 38 | | 2 | | 4 | 5 | 6 | 7 | 8 | | 10 | | | | | | 16 | | | | |
| 39 | 1 | 2 | 3 | 4 | 5 | 6 | 7 | 8 | 9 | 10 | 11 | 12 | 13 | 14 | | 16 | 17 | 18 | 19 | |
| 40 | 1 | | 3 | | 5 | | 7 | | 9 | | | | | | | | | | | |

FIG. 16

MULTI-LAYER FABRIC

This application is a continuation-in-part of U.S. patent application Ser. No. 10/334,166, filed Dec. 30, 2002, entitled DOUBLE CROSS PARALLEL BINDER FABRIC, which is incorporated herein by reference.

FIELD OF THE INVENTION

The present invention relates generally to papermaking technology, and more specifically, to fabrics for use with a papermaking machine.

DESCRIPTION OF THE PRIOR ART

During the papermaking process, a cellulosic fibrous web is formed by depositing a fibrous slurry, that is, an aqueous dispersion of cellulose fibers, onto a moving forming fabric in the forming section of a papermaking machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

The forming, press and dryer fabrics all take the form of endless loops on the paper machine and function in the manner of conveyors. It should further be appreciated that paper manufacture is a continuous process which proceeds at considerable speeds. That is to say, the pulp is continuously deposited onto the forming fabric in the forming section, while a newly manufactured paper sheet is continuously wound onto rolls after it exits from the dryer section.

Woven fabrics take many different forms. For example, they may be woven endless, or flat woven and subsequently rendered into endless form with a seam.

Forming fabrics play a critical role during the paper manufacturing process. One of its functions, as implied above, is to form and convey the paper product being manufactured to the press section. The forming fabric design, however, needs to address water removal and sheet formation constraints. That is, forming fabrics are designed to allow water to pass through (i.e. control the rate of drainage) while at the same time prevent fiber and other solids from passing through with the water. If drainage occurs too rapidly or too slowly, the sheet quality and machine efficiency suffers. To control drainage, the space within the forming fabric for the water to drain, commonly referred to as void volume, must be properly designed.

Contemporary forming fabrics are produced in a wide variety of styles designed to meet the requirements of the paper machines on which they are installed for the paper grades being manufactured. Generally, they comprise a base fabric woven from monofilament, and may be single-layered or multi-layered. The yarns are typically extruded from any one of several synthetic polymeric resins, such as polyamide and polyester resins, used for this purpose by those of ordinary skill in the paper machine clothing arts.

The design of forming fabrics additionally involves a compromise between the desired fiber support and fabric stability. A fine mesh fabric may provide the desired paper surface and fiber support properties, but such design may lack the desired stability resulting in a short fabric life. By contrast, coarse mesh fabrics provide stability and long life at the expense of fiber support and the potential for marking. To minimize the design tradeoff and optimize both support and stability, multi-layer fabrics have been developed. For example, in double and triple layer fabrics, the forming side is designed for sheet and fiber support while the wear side is designed for stability, void volume, and wear resistance.

Those skilled in the art will appreciate that fabrics are created by weaving, such that the resulting fabric has a weave pattern which repeats in both the warp or machine direction (MD) and the weft or cross-machine direction (CD).

Multi-layer fabrics, such as triple layer fabrics, may loosen during use and cause unacceptable levels of abrasion within the structure. The present invention provides a fabric which alleviates or overcomes such disadvantages.

SUMMARY OF THE INVENTION

In accordance with an illustrative embodiment of the present invention, there is provided a fabric useful for fabricating paper, the fabric including first and second layers, each having machine direction (MD) yarns and cross-direction (CD) yarns interwoven therewith. A plurality of binder pairs bind the first and second layers together. The binder pairs are interwoven so as to be an integral part of the first layer and contribute to a structure thereof. The binder pairs are a non-integral part of the second layer and do not contribute to a structure thereof. During a repeat pattern, at least one of the two binder yarns of a binder pair is integrally woven with the yarns of the first layer and passes over outer surfaces of two non-consecutive yarns in the second layer. As a result, a "double knuckle" binding structure may be formed which improves integrity of the resulting composite fabric by reducing the length of the binder yarn path through the fabric.

The above and other features and advantages of the present invention will become more apparent from the following detailed description of preferred embodiments thereof.

BRIEF DESCRIPTION OF THE DRAWINGS

The following detailed description, given by way of example and not intended to limit the present invention solely thereto, will best be appreciated in conjunction with the accompanying drawings, in which like reference numerals denote like elements and parts, wherein:

FIG. 7 depicts cross-sectional diagrams showing an illustrative CD yarn weave pattern of the first fabric;

FIG. 8 shows cross-sectional diagrams depicting an illustrative CD yarn weave pattern of the second fabric;

FIG. 16 is a view of a fabric pattern according to an embodiment of the present invention;

DETAILED DESCRIPTION OF THE PREFERRED EMBODIMENTS

Figure 1:
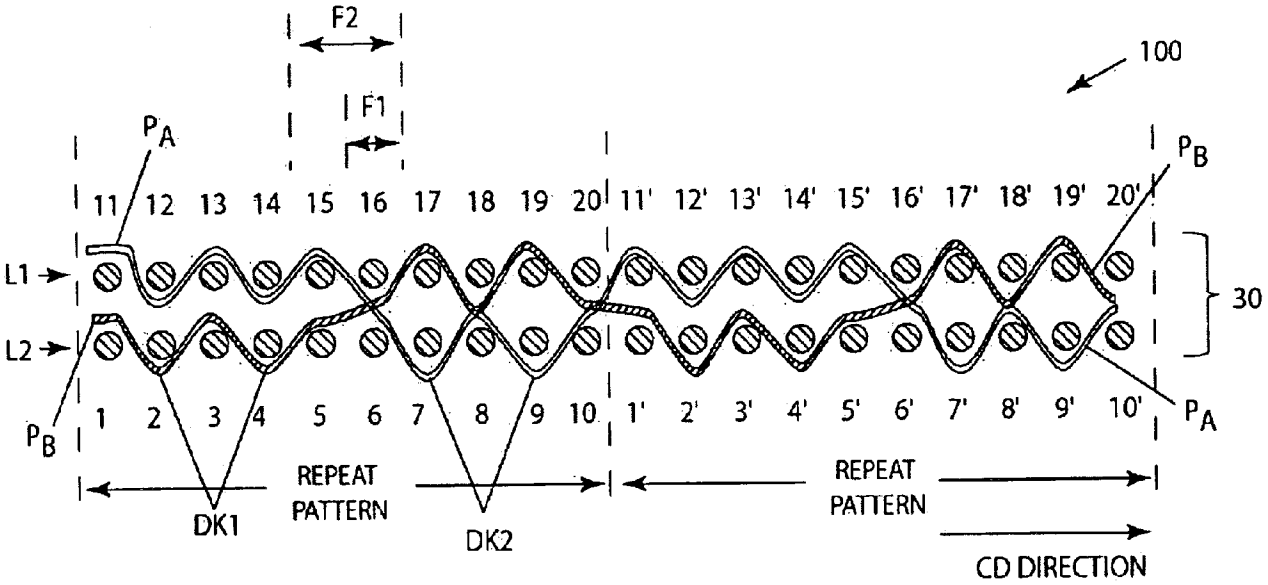
FIG. 1 is a cross-sectional view in the MD direction, of a portion of a first fabric depicting a binder pair in accordance with the present invention.

Referring now to FIG. 1, there is shown a cross-sectional illustration of a binder yarn pair that forms a part of a composite fabric 100 in accordance with an embodiment of the present invention. Fabric 100, which is advantageously employed in a paper-making process, is composed of an array of machine-direction (MD) yarns (warp yarns) and cross-machine direction (CD) yarns (weft yarns). MD yarns such as 1–20 are arranged in two layers, with yarns 1–10 arrayed in a bottom layer (or machine-side or "wear-side" layer) and yarns 11–20 arranged correspondingly in a top layer (or paper or forming side layer).

CD yarns PA and PB together constitute a pair of binder yarns, which are depicted in a binder pair segment pattern 30 according to one embodiment of the invention. Binder yarns PA, PB function to bind upper layer (L1) warp yarns to lower layer (L2) warp yarns to form the composite weave fabric 100. Binding is accomplished in this embodiment by means of binder yarn PA running in a cross-machine direction path that interweaves a number of warp yarns in the top layer L1, then crosses to lower layer L2 and interweaves a number of lower layer warp yarns, and subsequently crossing back to the upper layer to repeat the same or similar pattern. Likewise, binder yarn PB, which may run parallel and adjacent to binder yarn PA, or intertwined with yarn PA, binds upper and lower layer warp yarns in a similar fashion, and is preferably complementary to yarn PA. That is, by suitably arranging the crossing points of binder yarns PA and PB, a substantially uniform top side layer surface can be achieved, which is preferable for use as a paper side layer. As a result, the binder yarn pair 30 makes up a part of the structure of the top layer L1, whereby the binder pair can be considered an "intrinsic" type of binder pair which is an integral part of the top layer so as to contribute to a structure of the top layer. The binder pair, however, can be considered a non-integral part of the bottom layer so as not to contribute to a structure of the bottom layer. (It is noted here that in other embodiments of the invention, binder yarn pairs such as PA, PB can run in the MD direction to accomplish binding, instead of the CD direction.)

In the fabric portion illustrated in FIG. 1, two "repeat patterns" are shown, where the first comprises the portion of yarns PA and PB that bind the 20 warp yarns 1–20. The second repeat pattern binds MD yarns 1' to 20'. Each repeat pattern may be considered as encompassing ten "columns" of warps, with two layers per column, and two CD binder yarns PA, PB, together constituting at least a portion of a "row" of wefts in both layers. Further, binder yarns PA and PB may run in the CD direction closely to one another such that, when viewed from the top of fabric 100, the binder yarns PA and PB substantially overlay one another, i.e., they are nearly vertically aligned. Note that the use of the terms "columns" and "rows" herein is used for convenience of explanation, and is not intended to limit the invention to MD yarns and CD yarns that are necessarily orthogonal; for example, it is possible for the MD yarns to be skewed relative to one another. The warp yarns may be substantially uniform in cross section and spacing in the upper and lower layers, such as the illustrated yarns 1–20, although it is quite possible to employ warp yarns of differing cross section and shapes (e.g., cylindrical, elliptical, non-round or rectangular cross section) in the upper and lower layers. In the CD direction, the weft yarns may be arranged with differing patterns in successive rows, and the differing patterns may be designed to repeat every N rows, as will be discussed later. The CD yarns may have the same or different shapes and diameters as the warp yarns, and may be composed of the same or different material.

A characteristic feature of the binder yarn pair 30 is the formation of "double knuckle" structures such as DK1 or DK2. That is, a double knuckle DK2 is formed as yarn PA forms loops (knuckles) around outer surfaces of two non-consecutive warp yarns, 7 and 9, while crossing to above yarn 15 on one side and above yarn 11' on the other side. The double knuckle DK1 is likewise formed between yarns 2 to 4. Note that the illustrative double knuckles DK1 and DK2 are formed such that the two non-consecutive yarns that they loop around (e.g., yarns 7 and 9) have only one yarn (e.g., yarn 8) in the machine layer between them having an outer (bottom) surface of which the binder yarn does not pass over. It is contemplated, however, that in other binder embodiments of the present invention, more than one machine layer yarn can exist in between the "knuckles" of the double knuckle structure.

In any event, the double knuckle structure improves integrity of the resulting composite fabric by reducing the length of the binder yarn path through the fabric. That is, the structure results in short "internal floats" for the binder yarns. Better contact between the layers is achieved as compared to conventional designs, causing less contact yarn to yarn, and consequently less internal wear. Another effect is that the binder becomes more symmetric and therefore counteracts curling that can otherwise be a problem. The double knuckle is also locked into place in the second layer due to increased contact with multiple MD yarns. This differs from a conventional binder yarn which has some freedom to slide along a single MD yarn. Moreover, the double knuckle improves fabric seam strength.

The binder material is often a medium to high shrinkage material, while the backside shutes (e.g., weft W1 in layer L2 to be described below) are low shrinkage as standard. In the prior art, that combination results in significant curling. To balance the materials a more shrinkable bottom material can be used in embodiments of the present invention. In this case, the external wear resistance on the backside is, however, influenced negatively (less plain difference warp/shute). To compensate for the loss an alternative backside pattern with longer (e.g., 10-shed) floats can be used.

The binders used in the present invention can have "internal floats" that have a short or minimal length. The term internal float as used herein refers to the distance that a yarn travels in between upper and lower warp yarns of a composite fabric such as when crossing between the upper and lower layers of the composite fabric. By utilizing a short internal float for each binder, the reliability of the resulting composite fabric may be improved. In the embodiment of FIG. 1, for example, binder yarn PA interweaves warp yarns 11 through 15 by passing over yarn 11, under yarn 12, over 13, under 14 and over 15. Yarn PA then crosses from top layer L1 to bottom layer L2 by traveling between the two layers a distance (in the cross-machine direction) corresponding to one warp yarn plus a short distance on either side. Thus, an internal float F1 of binder yarn PA can be considered the distance the yarn travels between only one top and bottom MD yarn (which are in the same column in this embodiment), such as between yarns 6 and 16, plus a short inter-yarn distance on either side of these warp yarns.

Binder yarn PB, in the embodiment of FIG. 1, has a longer internal float, i.e., float F2, than the internal float F1 of yarn PA. That is, binder yarn PB interweaves warp yarns 1–4, then crosses from bottom layer L2 to top layer L1 by traveling from beneath yarn 4 to the internal region between yarns 5, 15 and then between yarns 6, 16, before arriving above yarn 17. Yarn PB then interweaves yarns 17 through 20. Hence the internal float F2 of yarn PB is the CD distance in the internal region traversed between yarns 5 and 15 as well as between yarns 6 and 16, plus the short inter-yarn distances on either side. Thus, internal float F2 has a length corresponding to two warp yarns (plus a short inter-yarn distance on both sides).

The binder yarn pair pattern 30 with the above-described internal float design, lends uniformity to the top surface of layer L1 (typically the paper side surface). That is, yarn PA interweaves top layer warp yarns 11–15 such that alternating yarns 11, 13 and 15 are beneath the binding yarn PA, and then yarn PB interweaves top layer yarns 17–20 such that alternating yarns 17 and 19 are beneath yarn PB. As a result, alternating yarns 11, 13, 15, 17 and 19 are beneath the binding pair yarns, whereby a substantially continuous plain-weave type stitching pattern on the top surface is obtained. The binder yarn pair 30 can be considered as an integral part of the top layer L1 surface so as to contribute to the structure thereof. However, binder yarn pair 30 is not considered an integral part of the bottom layer L2 surface, so as not to contribute to the structure thereof, as will become apparent below.

Figure 2:
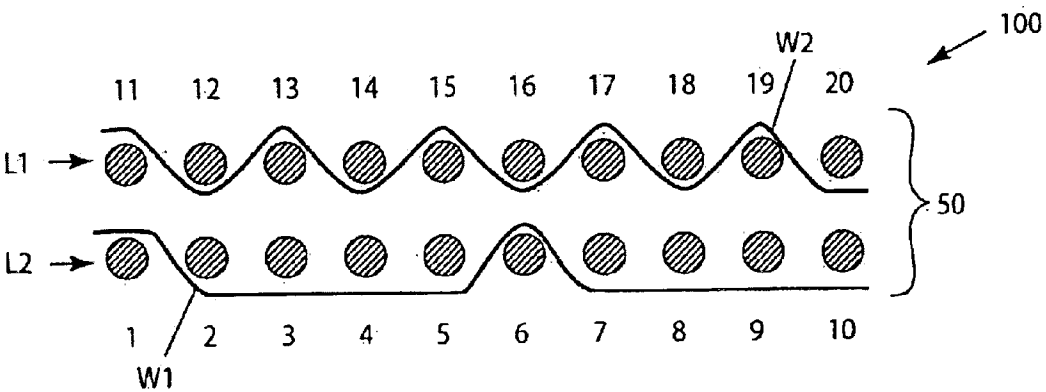
FIG. 2 is a cross-sectional view in the MD direction, of a different portion of the first fabric depicting cross-machine-direction (CD) yarns.
Figure 3:
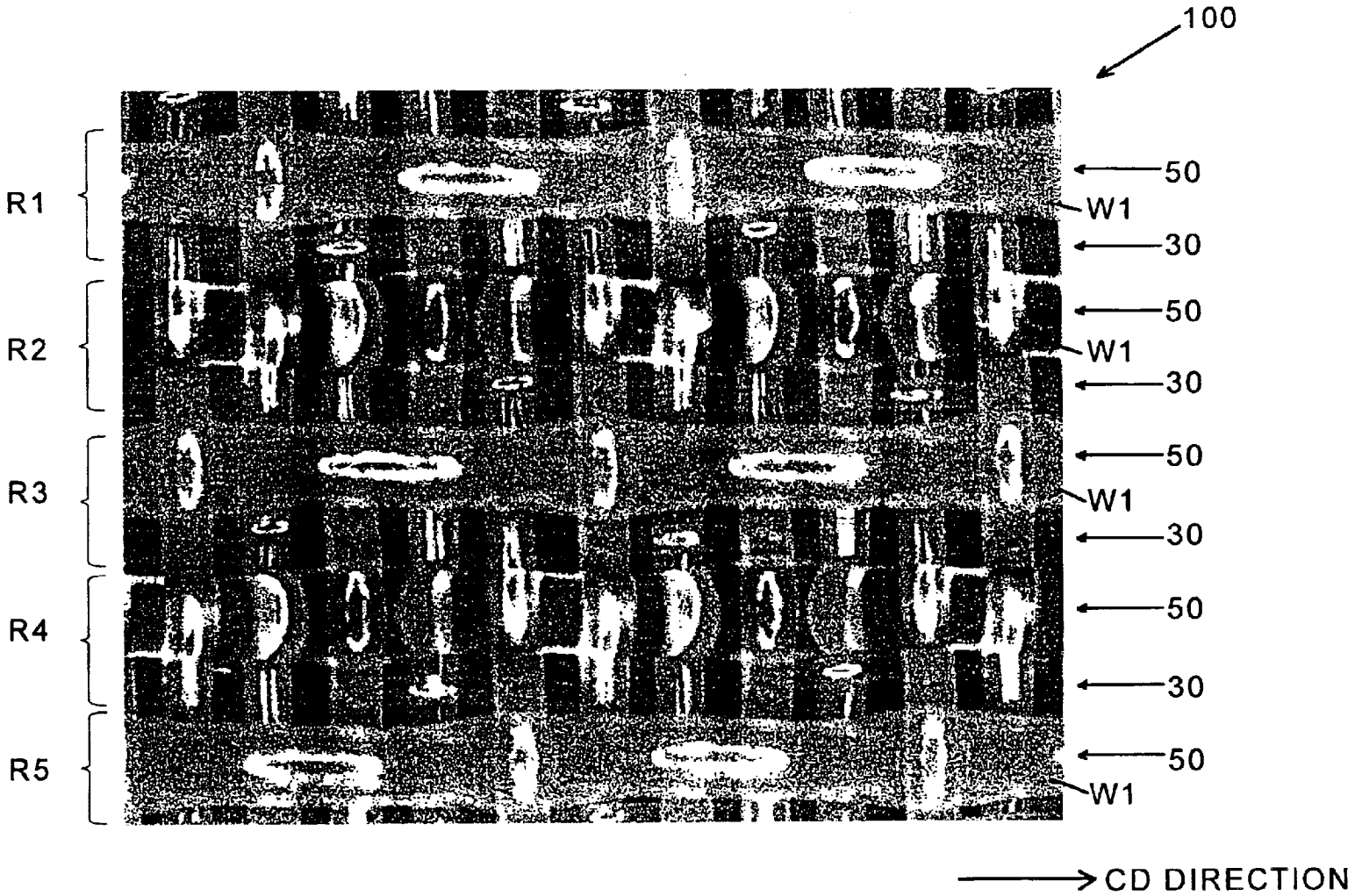
FIG. 3 is a wear-side photograph of the first fabric.

FIG. 2 illustrates a cross-sectional view showing weft (CD) yarns W1 and W2 of fabric 100. These yarns together run in a repetitive weave pattern 50 interweaving warp yarns 1–20. Weft yarn W2 interweaves only the top yarns 11–20 whereas weft yarn W1 interweaves only the bottom yarns 1–10. As seen in the photograph of FIG. 3, showing an illustrative wear-side (bottom) view of fabric 100, weft yarns W1 and W2 can run interspersed with binder yarn pairs 30. In the shown embodiment, lower layer weft yarns W1 are thicker than top layer weft yarns W2. (Only the wear side yarns W1 are clearly visible in FIG. 3).

With segment pattern 50 of FIG. 2, yarn W1 travels in a path that runs over MD yarn 1, beneath MD yarns 2–5, over MD yarn 6 and beneath MD yarns 7–10. Thus, the pattern of yarn W1 passes over (or "contours around") single warp yarns, such as yarns 1 and 6, every five yarns. The pattern can be varied such that yarn W1 passes over every Nth warp yarn, where N is more or fewer than five. Also, yarn W1 may pass over plural consecutive warp yarns rather than a single warp yarn as shown. It is noted that the cross-sectional area, shape (e.g., circular, elliptical, non-round, rectangular) and material used for yarn W1 may be the same as, or different than, that used for the CD binder yarns described earlier.

The yarns of FIGS. 1 and 2 are combinable into a composite fabric that has a 2:1 shute ratio. An exemplary total fabric containing these yarn patterns is discussed below in reference to FIG. 7.

Figure 4:
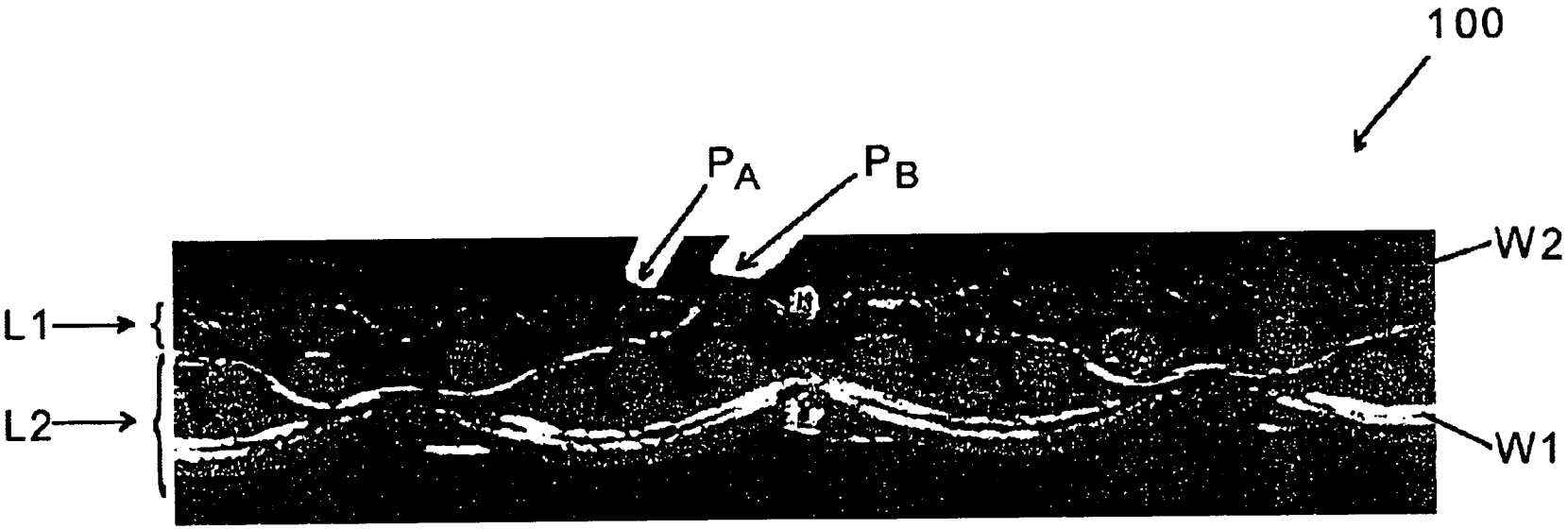
FIG. 4 is a photograph of a cross-section of the first fabric in the MD direction.

FIG. 4 is a photograph of a cross section of illustrative fabric 100, depicting a typical relationship between weft yarns W1, W2, binder yarns PA, PB and warp yarns 1–20. Weft yarn W1 is significantly larger than the other weft yarns in this embodiment. As a result, the thickness of bottom layer L2 is greater than that of top layer L1, whereby the bottom layer L2 is durable for the machine side of the paper making process. It is further apparent that due to the interweaving of yarn W1 and the binder yarns PA, PB, the bottom layer warp yarns 1–10 are no longer horizontally aligned as previously depicted in FIG. 1. On the other hand, the top layer L1 warp yarns 11–20 remain neatly aligned, whereby a substantially uniform top layer surface is attained.

Figure 5:
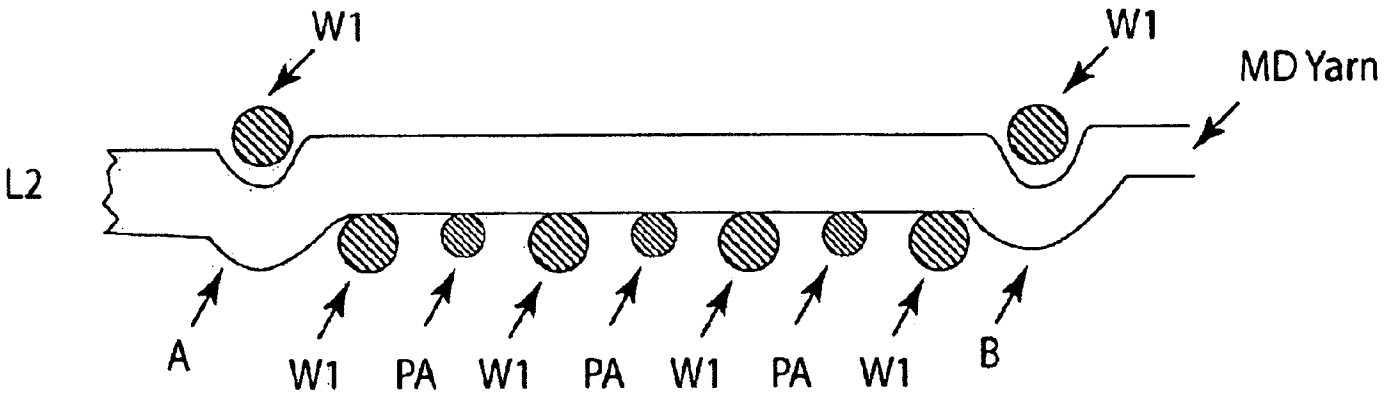
FIG. 5 is a cross-sectional view in the CD direction of a portion of the first fabric depicting a lower layer.

FIG. 5 is a cross-sectional view in the CD direction of a portion of fabric 100 depicting the lower layer L2. As seen in the figure, the MD yarns of fabric 100 such as yarn 1 do not run continuously in a horizontal plane. Rather, they dip down periodically as at points A and B due to the interweaving of the bottom layer weft yarns W1. In the MD direction, it is seen that binder yarns as PA can be alternatingly interspersed with weft yarns W1.

Figure 6:
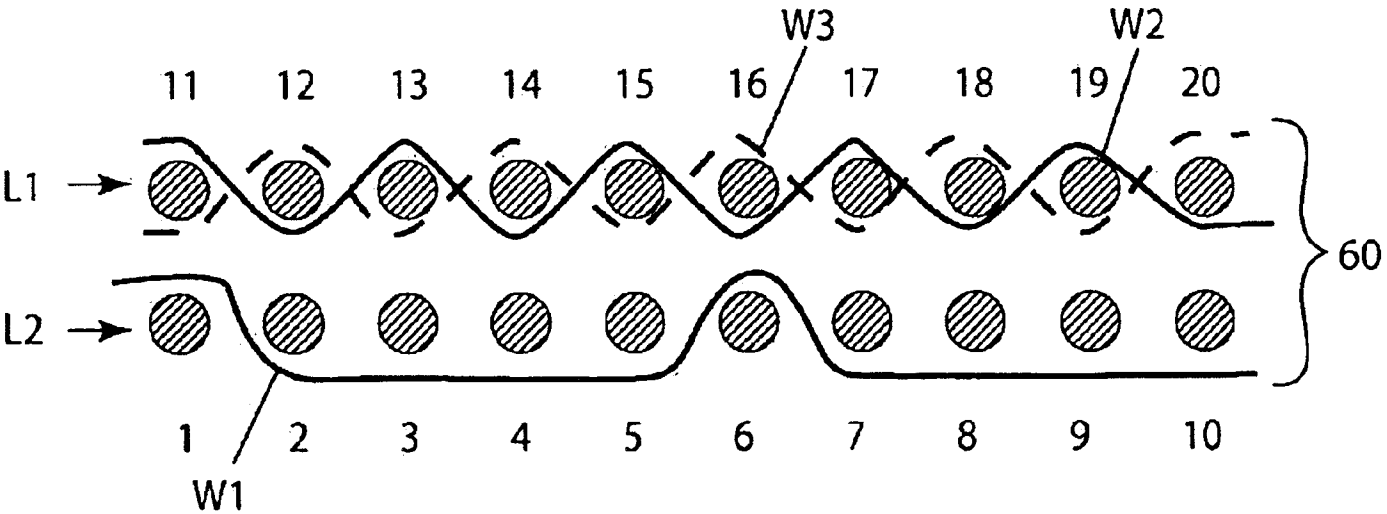
FIG. 6 is a cross-sectional view of a CD yarn arrangement of a second fabric in accordance with the present invention.

Referring now to FIG. 6, an alternative weft yarn arrangement/pattern 60 is shown which can be used in place of weft yarn arrangement 50 of FIG. 2 described above. That is, the yarns of FIGS. 1 and 6 may be combined to form an alternative embodiment of a composite fabric. (An exemplary full fabric containing these yarns is illustrated in FIG.

8 which is discussed below.) Weft yarn arrangement 60 differs by the addition of a third weft yarn, W3, that runs adjacent to yarn W2 and interweaves the top layer warp yarns 11–20. Weft yarn W3 runs in a complementary fashion to yarn W2 around warp yarns 11–20. For example, yarn W2 runs under yarn 12, over yarn 13, etc., while yarn W3 runs over yarn 12, under yarn 13, and so on. Although weft yarn W3 is illustrated with dashed lines for clarity, it is understood that this yarn can be similar or identical in composition and dimensions to weft yarn W2. In the cross section of FIG. 6, binder yarn pairs 30 are not shown for clarity; however, in a typical arrangement, one weft yarn arrangement 60 is employed in conjunction with one binder pair 30 to realize a 3:1 shute ratio. That is, three yarn patterns in the top layer are employed for every weft yarn W1 in the bottom layer, with the three top layer yarn patterns comprising yarn W2, yarn W3 and the yarns PA, PB of binder pair 30. This 3:1 shute arrangement will be described further below in connection with FIGS. 8–10.

Referring now to FIG. 7, there is shown an illustrative embodiment of a larger section of composite fabric 100. These figures illustrate an example of a row by row weft pattern layout illustrated in cross-sectional views in FIG. 7, and in a bottom view in FIG. 3. In FIG. 3, weft patterns in six rows R1 to R5 are depicted; and these are seen in the cross sectional diagrams of FIG. 7 for rows R1 to R5 (where the warp yarn cross-sections are replaced with their actual designating numbers 11, 12, etc., for clarity of illustration).

In the exemplary weft yarn sequence of FIG. 7, each row such as R1 is considered to contain four CD yarns, i.e., W1, W2, PA and PB. Row R1 contains yarns W1 and W2 designated in pattern $\mathbf{50}_1$ as well as binder yarns PA, PB designated with pattern $\mathbf{30}_1$; and so forth. Each of the 40 yarns in the sequence of FIG. 7 is also designated by a yarn number Y1–Y40. In this example, the 40 yarns Y1–Y40 can make up a repeat pattern in the MD direction. Thus, rows R1 to R10 are sequentially deployed in the MD direction, and can be followed by another set of the same rows R1 to R10, and so forth. Typically, the wear-side layer weft yarn W1 is thicker than the paper side layer weft yarns W2 and the binder yarns PA, PB, such that two paper side weave patterns, i.e., the weave pattern of yarn W2 and that of binder pair 30, are employed for every wear-side yarn W1.

In the successive rows R1, R2, etc., the patterns of the wear side yarns W1 are displaced in the CD direction. Thus, for example, in pattern $\mathbf{50}_1$ of row R1, yarn W1 loops over warp yarns 1 and 6; but in pattern $\mathbf{50}_2$ of row R2, yarn W1 loops over warp yarns 3 and 8; and so forth. In this manner, all of the bottom layer yarns are interwoven. Similarly, the binder yarn patterns are displaced from row to row: each repeat pattern $\mathbf{30}_1$ to $\mathbf{30}_{10}$ can each be thought of as a different portion of the two combined repeat patterns 30 of FIG. 1. For instance, repeat pattern $\mathbf{30}_1$ is the same as the pattern 30 between sheds 1–20 of FIG. 1; whereas repeat pattern $\mathbf{30}_2$ is the same as the pattern 30 between sheds 9, 19 and 9', 19' of FIG. 1. Thus, as the binding yarn patterns are displaced from row to row, a complete binding of the upper and lower layers is achieved.

With reference now to FIG. 8, an alternative weft yarn sequence is illustrated. This sequence differs from that of FIG. 7 in that the weft yarn arrangement 50 is replaced with the arrangement 60 shown in FIG. 6, resulting in the above-mentioned 3:1 shute ratio. In particular, three top (paper) layer weft patterns are deployed—i.e., the patterns of wefts W2, W3 and that of the paired binder 30—for every lower layer (wear-side layer) weft yarn W1. Thus, each of rows R1 to R10 is considered to contain five yarns, whereby a total of 50 yarns Y1 to Y50 are contained in each repeat pattern in the MD direction.

Figure 9:
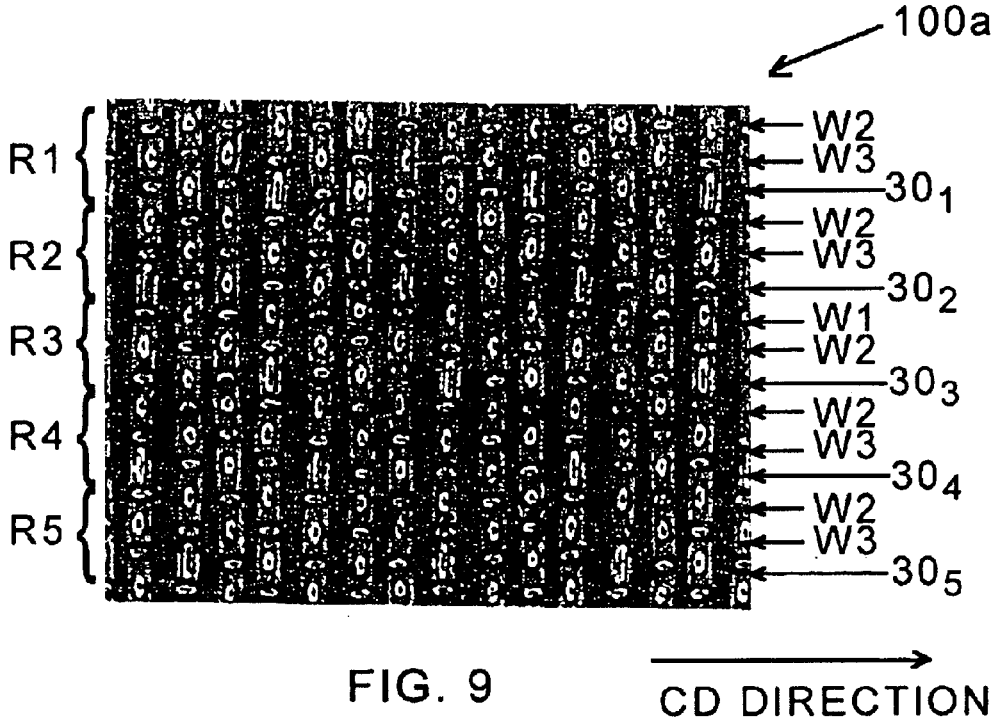
FIG. 9 is a photograph of a paper side view of the second fabric.
Figure 10:
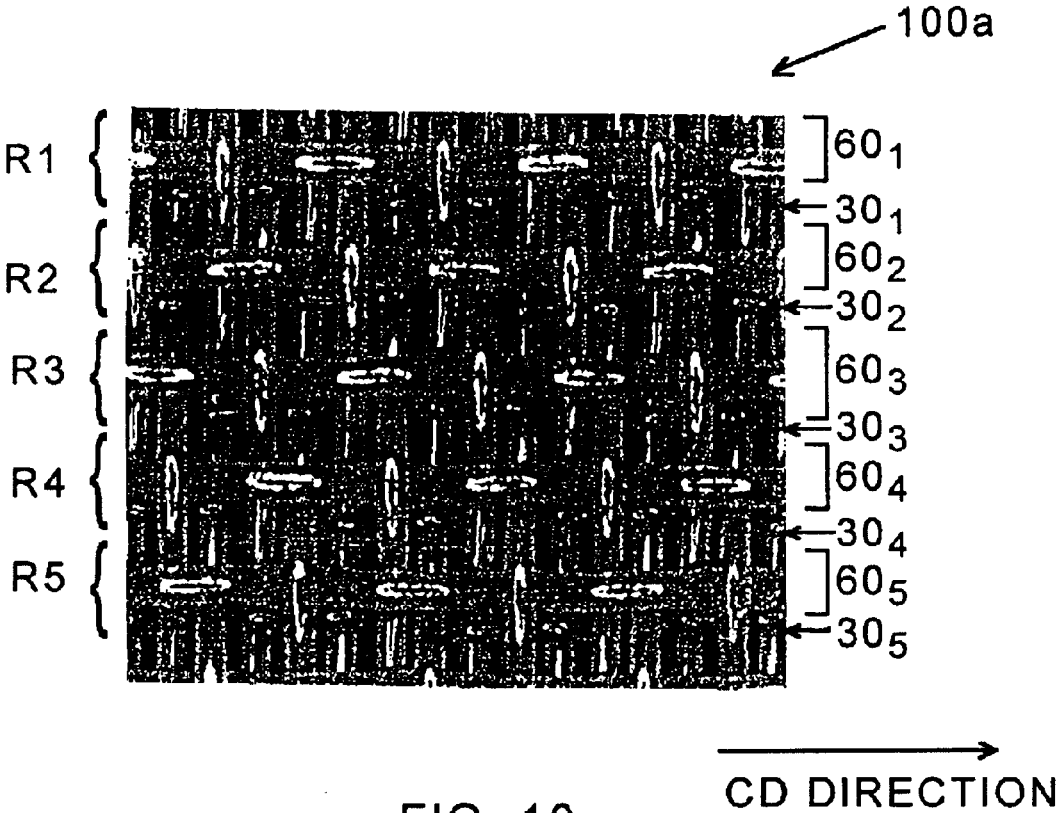
FIG. 10 is a photograph of a wear-side view of the second fabric.

FIGS. 9 and 10 are paper side and wear side photographs, respectively, of an actual fabric, designated as 100*a,* that contains the weave pattern sequence of FIG. 8. It is seen from the top view that each row such as R1 contains three adjacent top layer weave patterns formed from yarns W2, W3 and the binders PA, PB of pattern $\mathbf{30}_1$. From the wear side view it is seen that each row as R1 contains one bottom layer weft yarn W1. Thus, each row Ri contains one weave arrangement 60*i* and one paired binder 30*i*.

In yet another variation of the present invention, double cross parallel (DCP) type binder pairs may be employed in rows or locations interspersed with any of the binder patterns and weft patterns discussed above. Such DCP type binder pairs are disclosed in U.S. patent application Ser. No. 10/334,166 entitled DOUBLE CROSS PARALLEL BINDER FABRIC, which patent application is incorporated herein by reference. In a DCP binder pair, the two binders pass over at least one common (same) yarn on an outer surface of a layer such as the paper side layer within a repeating pattern.

Embodiments of the invention to be described below include DCP binder pairs. In particular, the below embodiments pertain to a fabric such as a triple layer fabric which may be utilized in a papermaking process. Such triple layer fabric may include a first (upper) layer and a second (lower) layer in which each of the first and second layers has a system of machine-direction (MD) yarns and cross-machine direction (CD) yarns interwoven therewith. The first layer may be a paper side or faceside layer upon which the cellulosic paper/fiber slurry is deposited during the papermaking process and the second layer may be a machine side or backside layer. The first and second layers may be held together by use of a number of stitching or binding yarns. Such stitching yarns may be a number of CD and/or MD yarns. For example, a number of pairs of CD yarns may be used wherein the two yarns of each pair are located adjacent to each other and work in parallel. A pair of such CD yarns may be an integral or non-integral part of the weave pattern of either or both of the first and second layers and may also bind the two layers together.

Figure 11A:
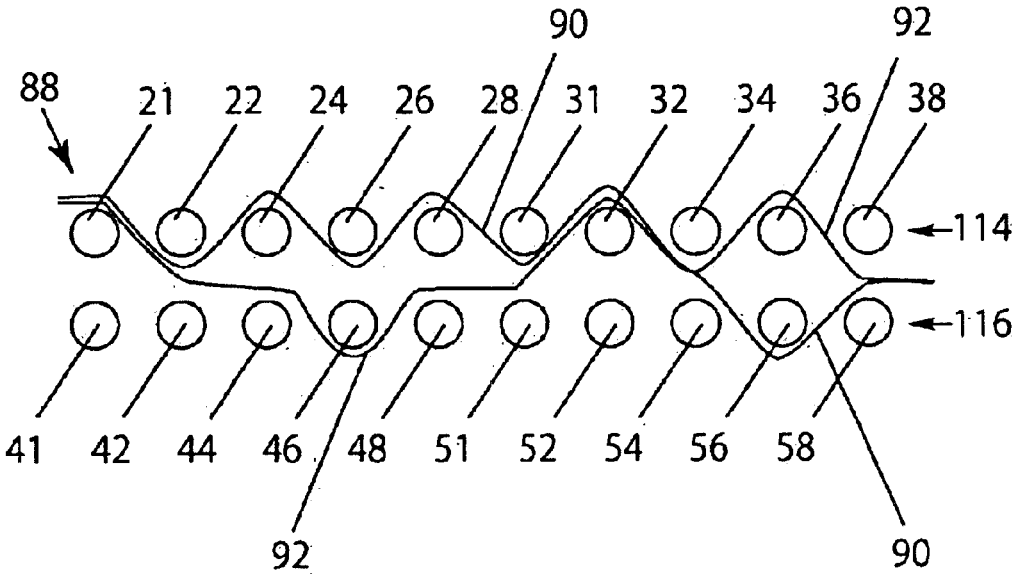
FIGS. 11A, 11B, and 11C are diagrams of cross-sectional views of a fabric according to another embodiment of the present invention.

FIG. 11A illustrates a portion or a repeating pattern of a binding pair 88. More specifically, FIG. 11A is a cross-sectional view of a part of a fabric 100' which includes a first (paper side) layer L14 and a second (machine side) layer L16 having a plurality of MD yarns 21–38 in the paper side layer L14, a plurality of MD yarns 41–58 in the machine side layer L16, and a number of binding pairs 88 each having CD yarns 90 and 92 interwoven with the MD yarns. As shown therein, CD yarn 90 passes over MD yarns 21, 24, 28, and 32 and passes under MD yarns 22, 26, 31, 34 and 38 of the paper side layer L14, and passes under MD yarn 56 of the machine side layer L16. CD yarn 92 passes over MD yarns 21, 32, and 36 and passes under MD yarns 22, 24, 28, 31, 34, and 38 of the paper side layer L14, passes over MD yarns 42, 44, 48, and 51 and passes under MD yarn 46 of the machine layer L16.

Figure 11B:
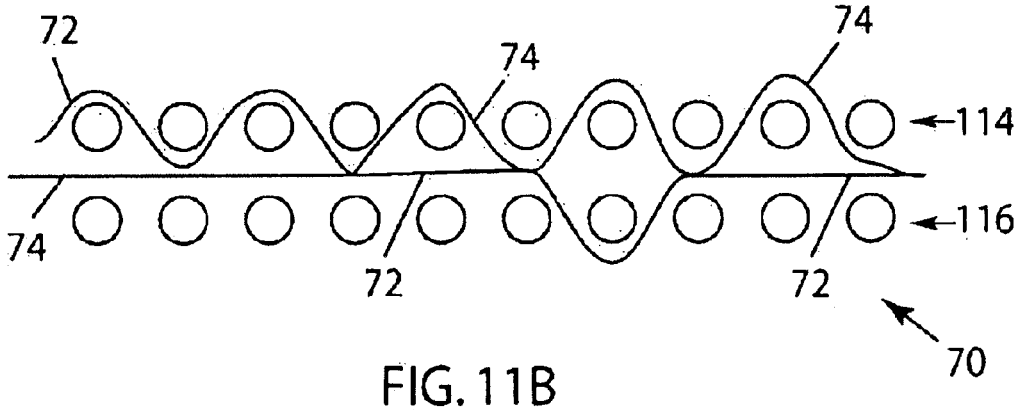
Figure 11C:
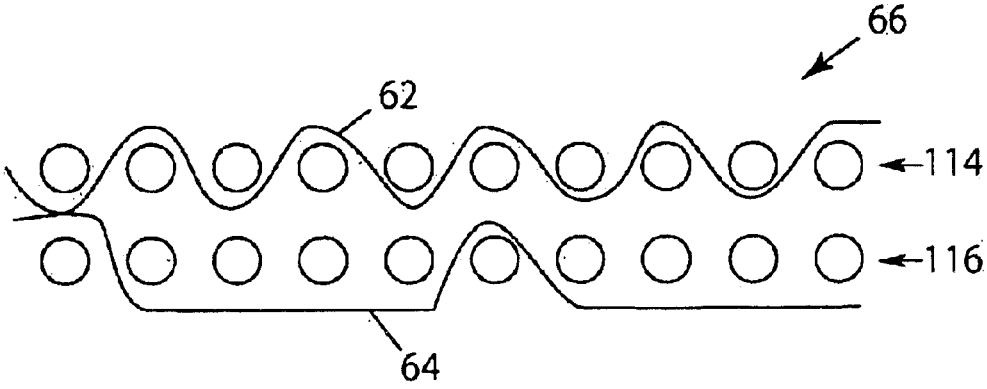
Figure 11D:
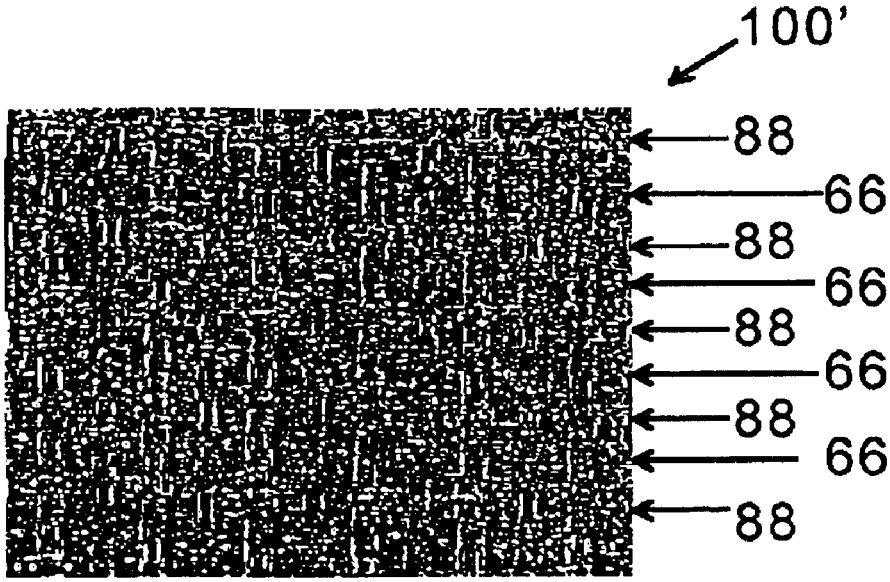
FIGS. 11D and 11E are respective paper side and machine side views of a fabric woven in accordance with the present invention.
Figure 11E:
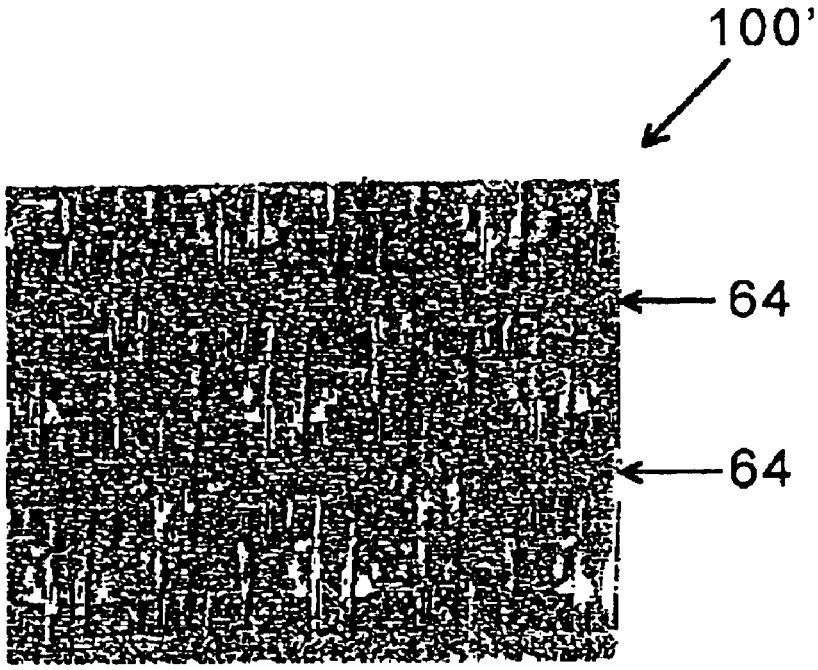

A plurality of binding pairs 88 may be interwoven into fabric 100' as shown in FIG. 11D (which is a paper side view of the fabric) and FIG. 11E (which is a machine side view of the fabric). Additionally, a number of CD pairs 66 may also be interwoven into the fabric 100' and arranged therein between adjacent ones of the binding pairs 88. Each of the CD pairs may have CD yarns 62 and 64 which may be interwoven with the MD yarns of the paper side layer L14 and the machine side layer L16 as shown in FIG. 11C. Further, a number of pairs 70 each including CD yarns 72 and 74 may also be interwoven with the MD yarns of the paper side layer L14 and machine side layer L16 of the fabric 100' as, for example, shown in FIG. 11B.

Therefore, in the fabric 100', each of the yarns 90 and 92 of the binding pair 88 passes over MD yarns 21 and 32 on an outer surface of the paper side layer L14. Such type of binding pair is hereinafter referred to as a double cross parallel (DCP) type binder pair. Accordingly, the fabric 100' has two interwoven layers of CD and MD yarns which are held together by a plurality of DCP type binder pairs wherein the two yarns of each such binder pair pass over two MD yarns on an outer surface of the paper side L14 within a repeat pattern.

Another fabric will now be described with reference to FIGS. 12A–D.

Figure 12A:
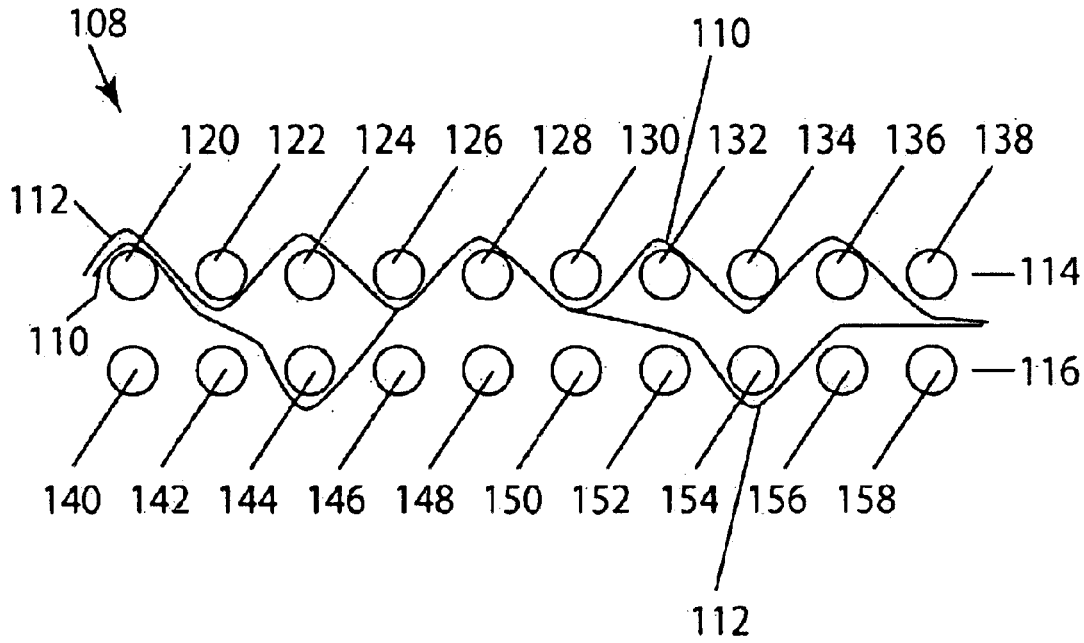
FIGS. 12A and 12B are diagrams of cross-sectional views of a fabric according to a further embodiment of the present invention.
Figure 12B:
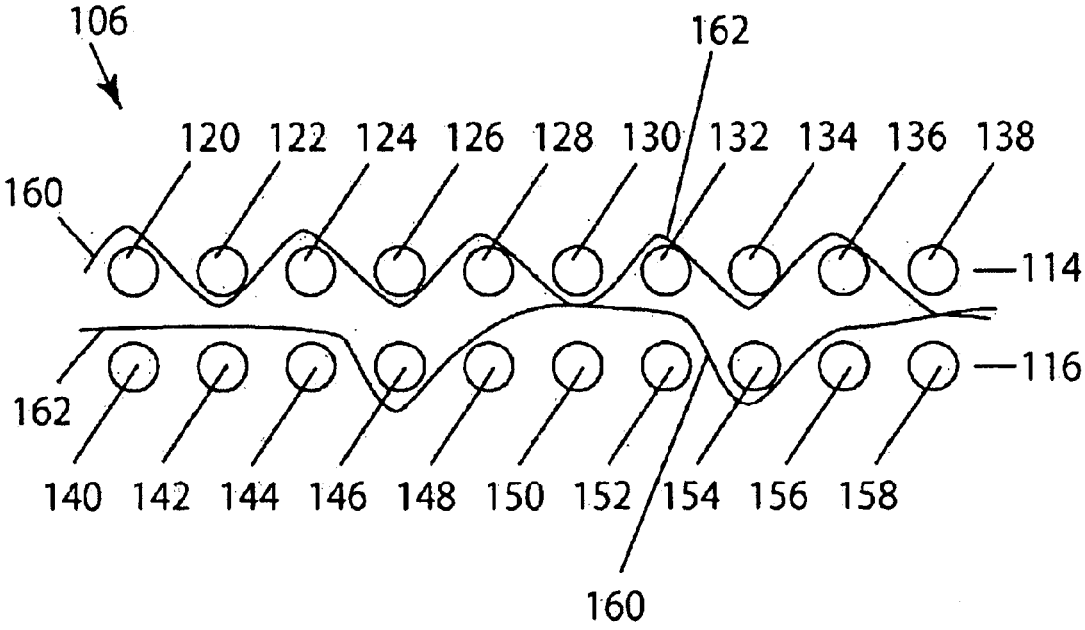
Figure 12C:
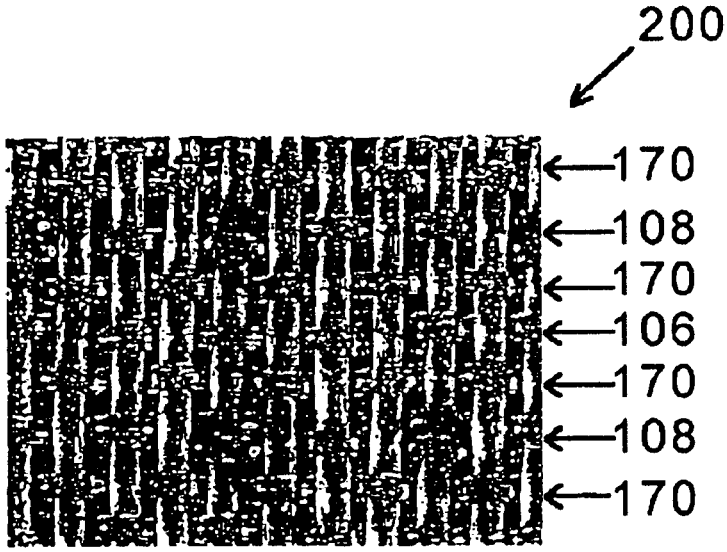
FIGS. 12C and 12D are paper side and machine side views of a fabric woven in accordance with the present invention.
Figure 12D:
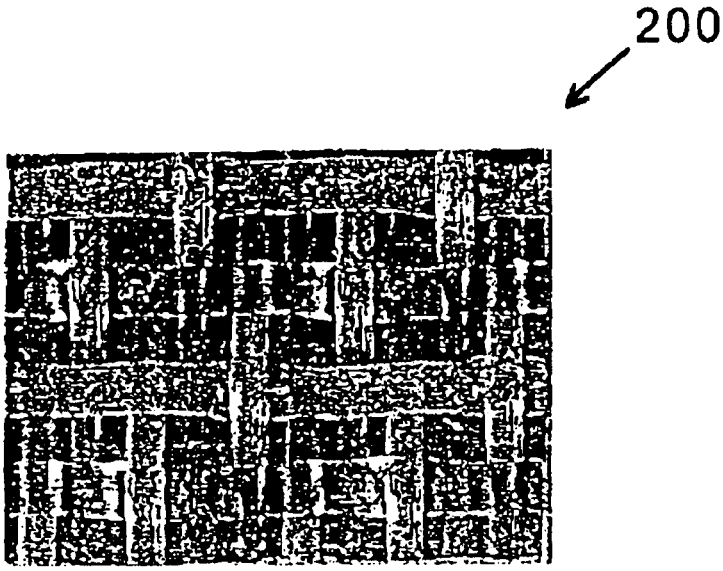

FIG. 12A illustrates a portion or a repeating pattern of a binding pair 108 of a fabric 200 having a first (paper side) layer 114 and a second (machine side) layer 116. More specifically, FIG. 12A is a cross-sectional view illustrating a plurality of MD yarns 120–138 in the paper side layer 114, a plurality of MD yarns 140–158 in the machine side layer 116, and binding pair 108 having CD yarns 110 and 112 interwoven with the MD yarns. As shown in FIG. 12A, in binder pair 108, CD yarn 110 passes over MD yarns 120, 128, 132, and 136 and passes under MD yarns 122, 126, 130, 134 and 138 of the paper side layer 114, and passes under MD yarn 144 of the machine side layer 116. CD yarn 112 passes over MD yarns 120, 124, and 128 and passes under MD yarns 122, 126, 130, 132, 136 and 138 of the paper side layer 114, and passes over MD yarns 152, 156, and 158 and passes under MD yarn 154 of the machine layer 116. A number of binding pairs 108 may be interwoven into fabric 200 as shown in FIG. 12C (which is a paper side view of the fabric) and FIG. 12D (which is a machine side view of the fabric).

Additionally, a number of binder pairs 106 each having CD yarns 160 and 162 may also be interwoven with the MD yarns of the fabric 200 and arranged therein in an alternating manner with the binding pairs 108. Each of the binder pairs 106 (which may be referred to as a support shute binder (SSB) type) may have CD yarns 160 and 162 which may be interwoven with the MD yarns of the paper side layer 114 and the machine side layer 116 as shown in FIG. 12B. As illustrated in FIG. 12B, CD yarns 160 and 162 do not pass over one or more same MD yarns on an outer surface of the paper side layer 114. Further, a number of CD yarns 170 may also be interwoven into the fabric 200 and arranged such that respective ones of CD yarns 170 are located on either side of binding pairs 106 and 108 as, for example, shown in FIG. 12C. CD yarns 170 may be similar to CD yarns 62 and 64 shown in FIG. 11C.

Therefore, in the fabric 200, each of the yarns 110 and 112 of the binding pair 108 passes over MD yarns 120 and 128 on an outer surface of the paper side layer 114. Thus, binding pair 108 is a DCP type binder pair. Accordingly, the fabric 200 has two interwoven layers of CD and MD yarns which are held together by a plurality of DCP type binder pairs wherein the two yarns of each such binder pair pass over two MD yarns on an outer surface of the paper side 114 within a repeat pattern. Further, the arrangement of binders in the fabric 200 enables relatively high permeability.

Another fabric will now be described with reference to FIGS. 13A–D.

Figure 13A:
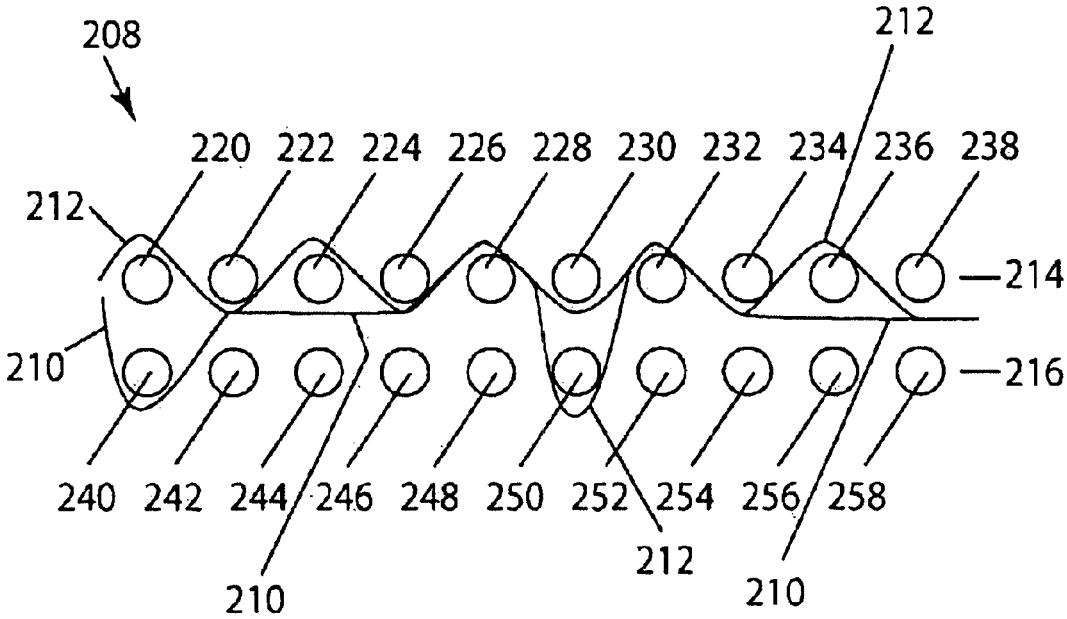
FIGS. 13A and 13B are diagrams of cross-sectional views of a fabric according to yet another embodiment of the present invention.

FIG. 13A illustrates a portion or a repeating pattern of a binding pair 208 having a first (paper side) layer 214 and a second (machine side) layer 216. More specifically, FIG. 13A is a cross-sectional view of a part of a fabric 300 illustrating a plurality of MD yarns 220–238 in the paper side layer 214, a plurality of MD yarns 240–258 in the machine side layer 216, and binding pair 208 having CD yarns 210 and 212 interwoven with the MD yarns. As shown therein, CD yarn 212 passes over MD yarns 220, 224, 228, 232, and 236 and passes under MD yarns 222, 226, 234 and 238 of the paper side layer 214, and passes under MD yarn 250 of the machine side layer 116. CD yarn 210 passes over MD yarns 228 and 232 and passes under MD yarns 230 and 234 of the paper side layer 214, and passes over MD yarns 240, 244, 246, 256, and 258 and passes under MD yarn 240 of the machine layer 216. A number of binding pairs 208 may be interwoven into fabric 300 as shown in FIG. 13C (which is a paper side view of the fabric) and FIG. 13D (which is a machine side view of the fabric).

Figure 13B:
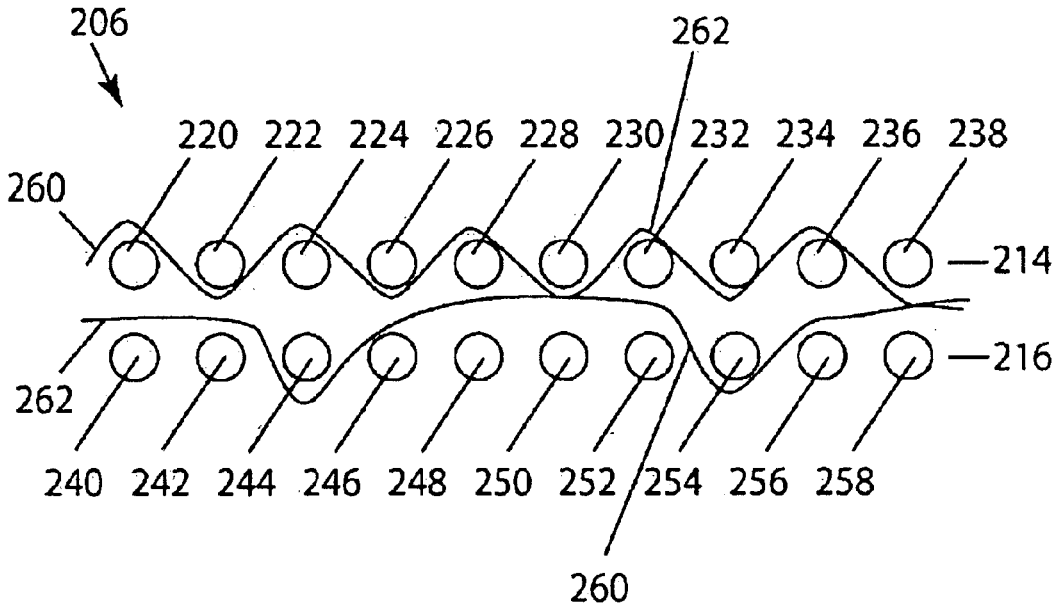

Additionally, a number of binding pairs 206 may be interwoven in the fabric 300 and arranged therein in an alternating manner with the binding pairs 208. Each of the pairs 206 (which may be SSB type binders) may have CD yarns 260 and 262 which may be interwoven with the MD yarns of the paper side layer 214 and the machine side layer 216 as shown in FIG. 13B. As illustrated in FIG. 13B, CD yarns 260 and 262 do not pass over one or more same MD yarns on an outer surface of the paper side layer 214.

Figure 13C:
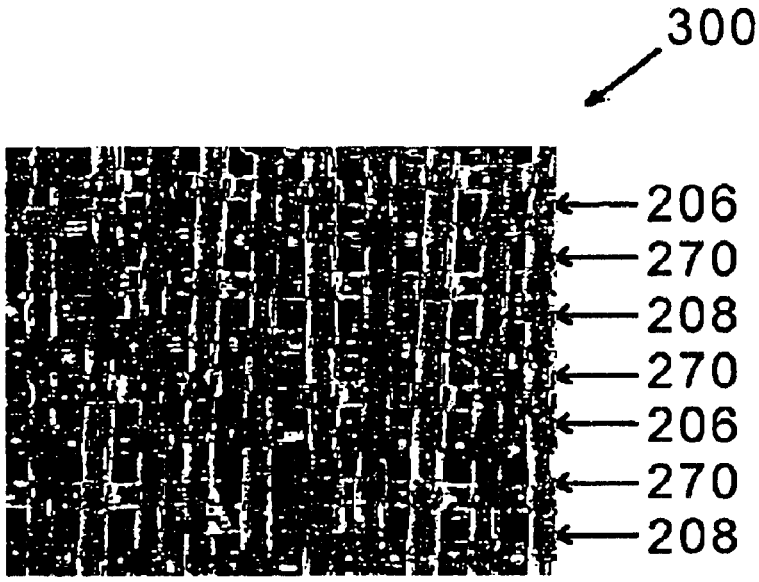
FIGS. 13C and 13D are paper side and machine side views, respectively, of a fabric woven in accordance with the present invention.
Figure 13D:
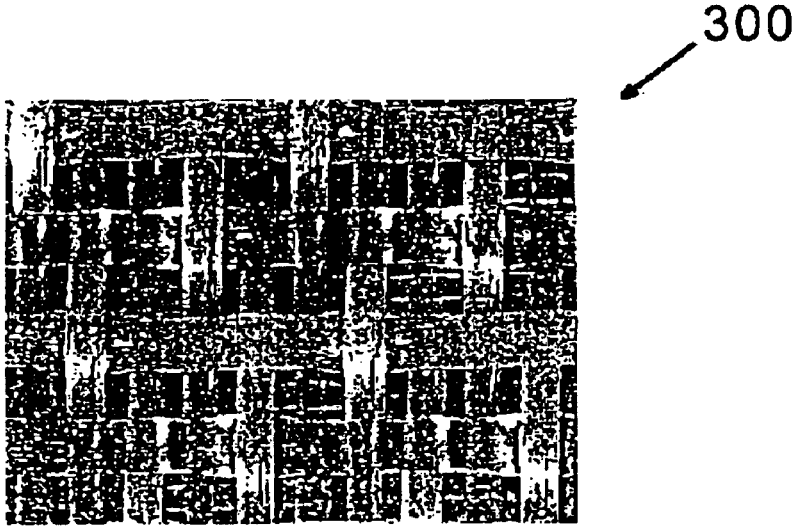

Further, a number of CD yarns 270 may also be interwoven into the fabric 300 and arranged such that respective ones of CD yarns 270 are located on either side of binding pairs 208 and CD pairs 206 as, for example, shown in FIG. 13C. CD yarns 270 may be similar to CD yarns 62 and 64 shown in FIG. 11C.

Therefore, in the fabric 300, each of the yarns 210 and 212 of the binding pair 208 passes over MD yarns 228 and 232 on an outer surface of the paper side layer 214. Thus, binding pair 208 is a DCP type binder pair. Accordingly, the fabric 300 has two interwoven layers of CD and MD yarns which are held together by a plurality of DCP type binder pairs and SSB type binder pairs wherein the two yarns of each DCP binder pair pass over two MD yarns on an outer surface of the paper side 14 within a repeat pattern. Further, the arrangement of binders in the fabric 300 may provide a direct pass from the top to the bottom and, as such, may improve the internal wear resistance of the fabric as compared to fabrics having other arrangements.

Yet another fabric will now be described with reference to FIGS. 14A–D.

Figure 14A:
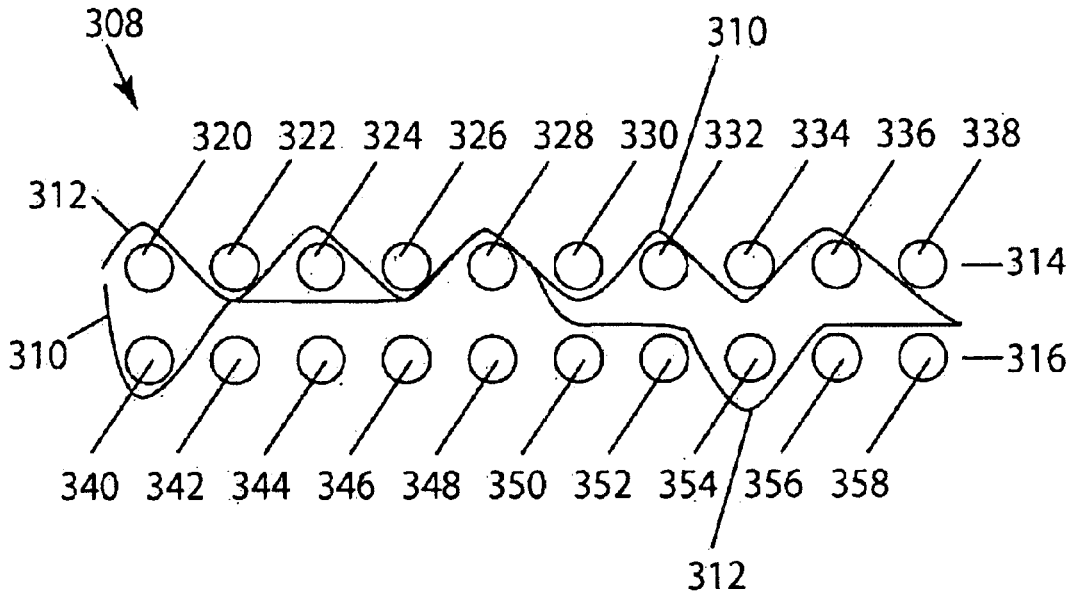
FIGS. 14A and 14B are diagrams of cross-sectional views of a fabric according to an additional embodiment of the present invention.

FIG. 14A illustrates a portion or a repeating pattern of a binding pair 308 of a fabric 400 having a first (paper side) layer 314 and a second (machine side) layer 316. More specifically, FIG. 14A is a cross-sectional view illustrating a plurality of MD yarns 320–338 in the paper side layer 314, a plurality of MD yarns 340–358 in the machine side layer 316, and binding pair 308 having CD yarns 310 and 312 interwoven with the MD yarns. As shown, CD yarn 312 passes over MD yarns 320, 324, and 328 and passes under MD yarns 322, 326, and 330 of the paper side layer 314, and passes under MD yarn 354 of the machine side layer 316. CD yarn 310 passes over MD yarn 328 and passes under MD yarn 330 of the paper side layer 314, and passes over MD yarns 342, 344, and 346 and passes under MD yarn 340 of the machine layer 316. A number of binding pairs 308 may be interwoven into fabric 400 as shown in FIG. 14C (which is a paper side view of the fabric) and FIG. 14D (which is a machine side view of the fabric).

Figure 14B:
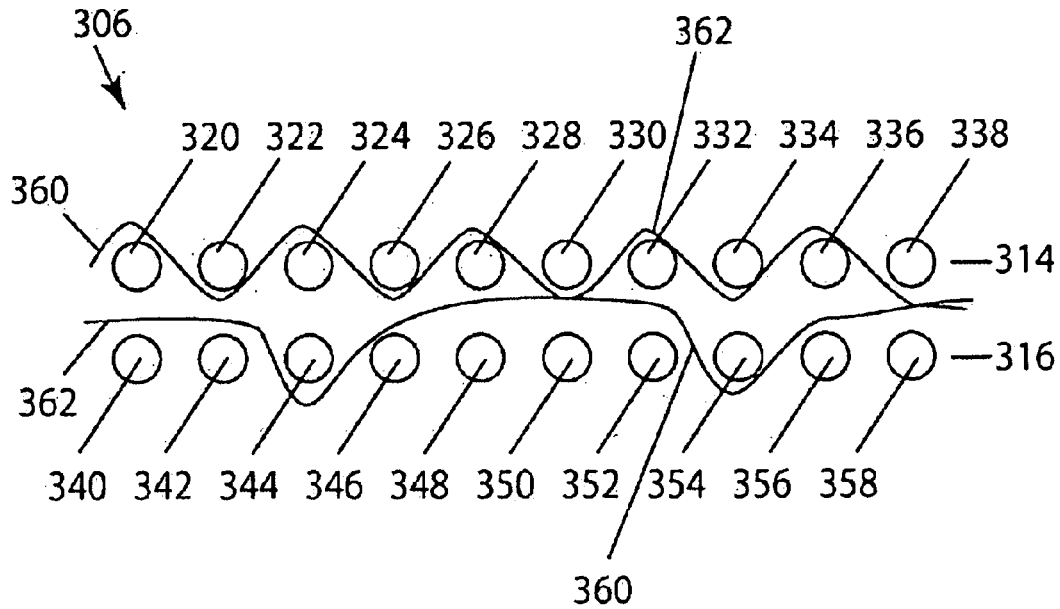

Additionally, a number of binder pairs 306 may also be interwoven into the fabric 400 and arranged therein in an alternating manner with the binding pairs 308. Each of the binder pairs 306 (which may be SSB type binders) may have CD yarns 360 and 362 which may be interwoven with the MD yarns of the paper side layer 314 and the machine side layer 316 as shown in FIG. 14B. As illustrated in FIG. 14B, CD yarns 260 and 262 do not pass over one or more same MD yarns on an outer surface of the paper side layer 314.

Figure 14C:
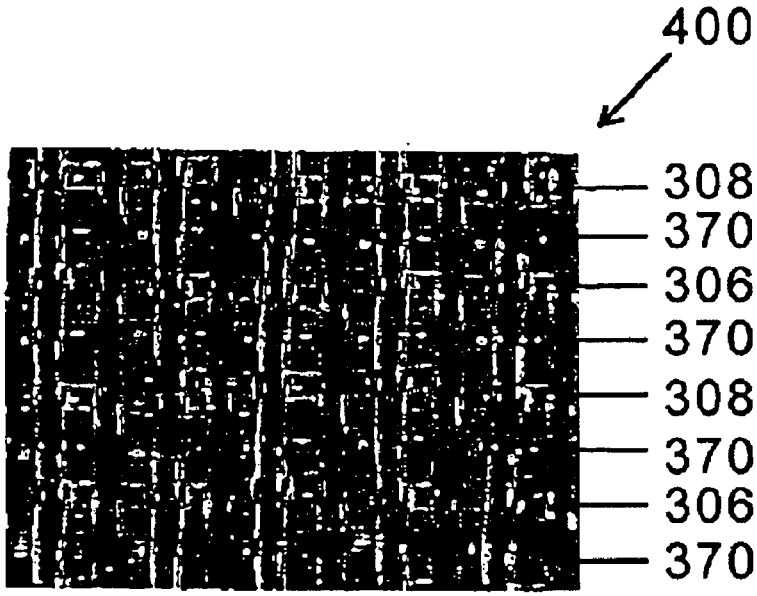
FIGS. 14C and 14D are paper side and machine side views, respectively, of a fabric woven in accordance with the present invention.
Figure 14D:
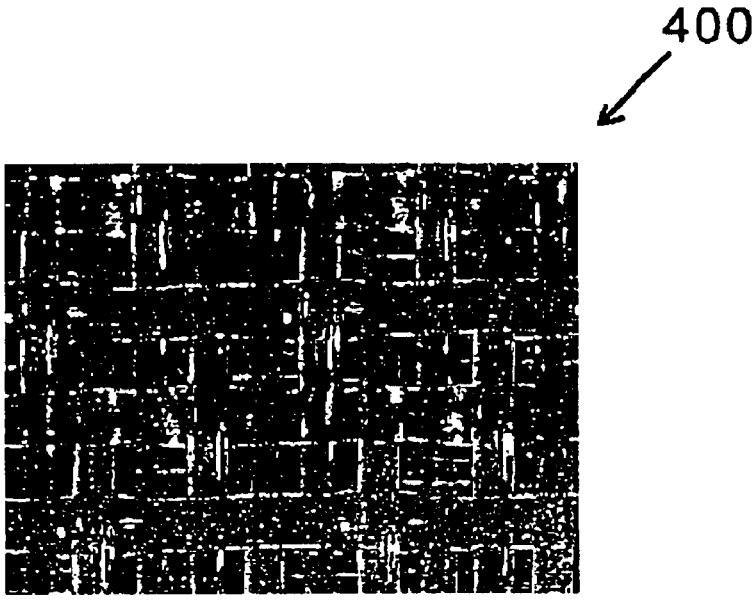

Further, a number of CD yarns 370 may also be interwoven into the fabric 400 and arranged such that respective ones of CD yarns 370 are located on either side of binding pairs 306 and 308 as, for example, shown in FIG. 14C. CD yarns 370 may be similar to CD yarns 62 and 64 shown in FIG. 11C.

Therefore, each of the yarns 310 and 312 of the binding pair 308 passes over MD yarn 328 on an outer surface of the paper side layer 314. Thus, binding pair 308 is a DCP type binder pair.

Accordingly, the fabric 400 has two interwoven layers of CD and MD yarns which are held together by a plurality of DCP type binder pairs and SSB type binder pairs wherein the two yarns of each DCP binder pair pass over only one MD yarn on an outer surface of the paper side 314 within a repeat pattern. As a result, the MD or warps yarns may be offstacked and a symmetric binder contour may be obtained. Further, such arrangement may minimize the number of crossings, decrease the level of marking, decrease the caliper, and improve the seamability as compared to fabrics having other arrangements.

In the above-described fabrics, the CD yarns of the DCP type binder pairs do not cross each other as they pass below a transitional top MD yarn. Instead, such yarns are adjacent to each other as they pass over one or more same MD yarns.

Figure 15:
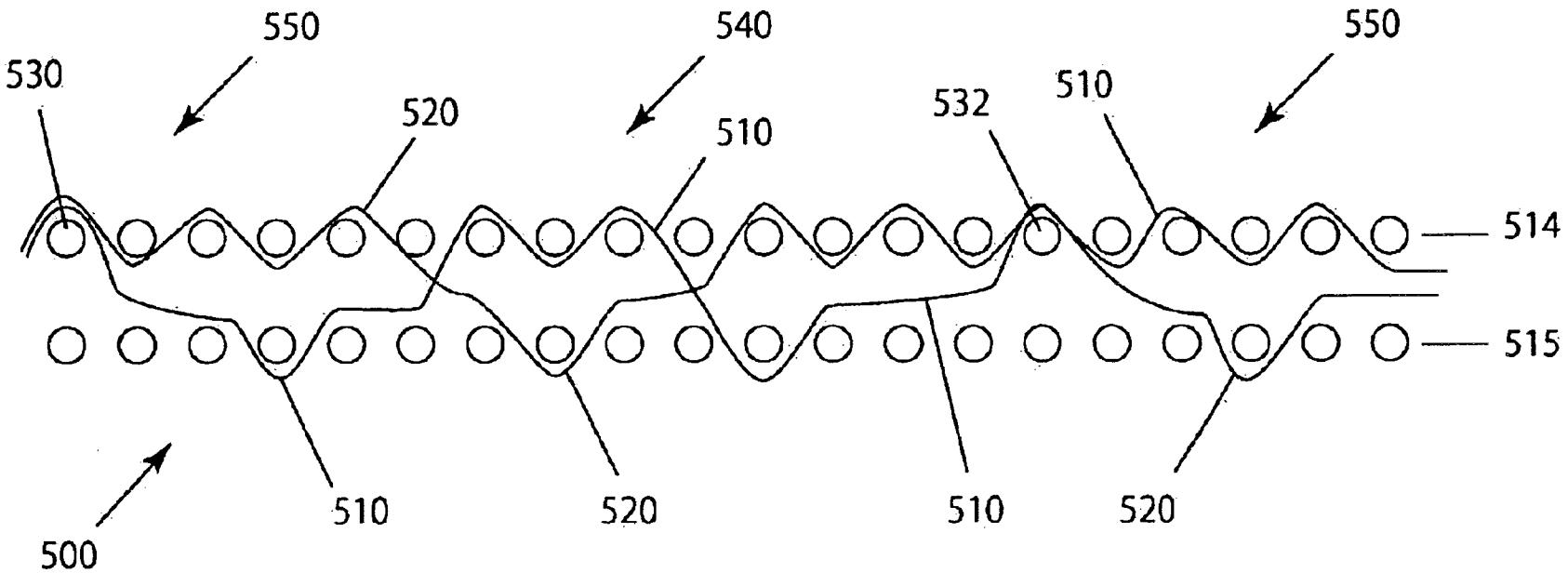
FIG. 15 is a diagram of cross-sectional view of a fabric according to another embodiment of the present invention.

Although specific patterns have been described above, the present invention is not so limited. For example, other patterns for the binder pairs such as that shown in FIG. 15 which includes a combination of DCP type binder pair and SSB binder pair within a repeat pattern. More specifically, FIG. 15 is a cross-sectional view of a part of a fabric 500 which includes a first (paper side) layer 514 and a second (machine side) layer 516 having a plurality of MD yarns therein and a number of binder pairs each having CD yarns 510 and 520. As shown in FIG. 15, CD yarns 510 and 520 each pass over MD yarns 530 and 532. The binder pair of FIG. 15 includes a number of DCP portions 550 and SSB portions 540. FIG. 16 illustrates a weaving pattern for a fabric which may use binder pairs. Additionally, the weave patterns for the upper (paper side) layer may be plain weave pattern or other patterns. Similarly, the lower (machine side) may be woven on 4, 5, or 6 sheds, or other arrangements may be used.

Figure 17A:
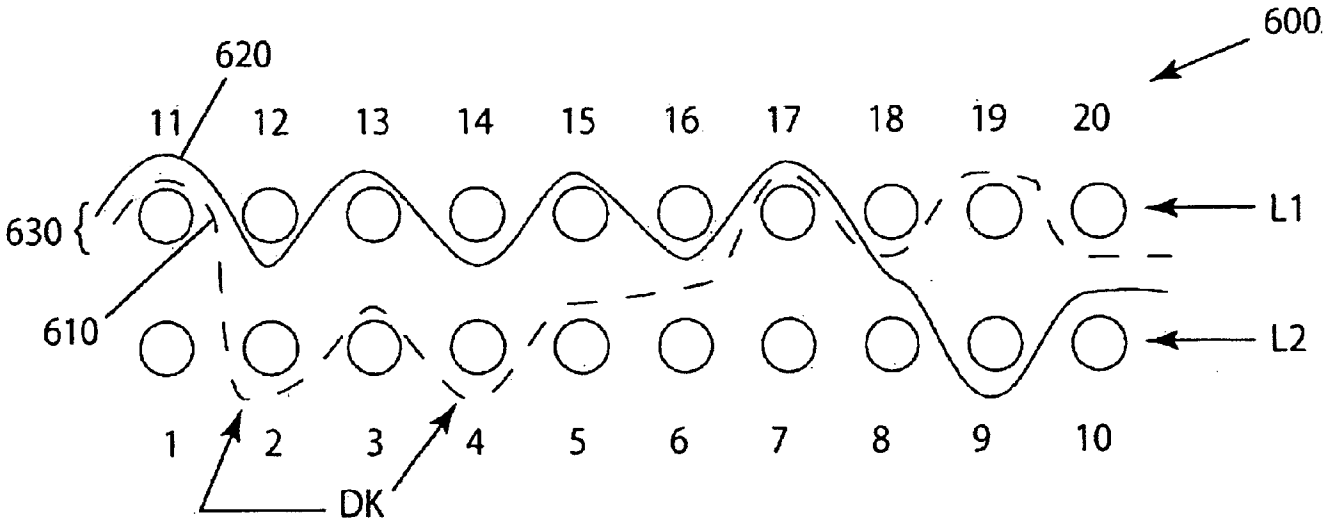
FIG. 17A illustrates a further binder pair embodiment of the present invention.

FIG. 17A illustrates in cross section yet another binder pair, 630, in accordance with the invention, which forms a part of a composite fabric 600. Binder yarns 610 and 620 together comprise binder pair 630, which binds together the yarns of paper side layer L1 and wear (machine) side layer L2. Binder pair 630 can be considered to provide a combination of the double knuckle structure of the binder 30 described above and the DCP binders also described above. The shown pattern of binder pair 630 can be a repeat pattern which repeats in the CD direction. Yarn 610 forms a double knuckle DK around yarns 2 to 4, and this double knuckle affords the advantages mentioned earlier, e.g., improving integrity of the resulting composite fabric by reducing the length of the binder yarn path through the fabric, improving fabric seam strength, etc. In addition, the co-location of binder yarns 610 and 620 at locations above warp yarns 11 and 17, for example, renders the binder pair a DCP-type binder with the attendant advantages.

Figure 17B:
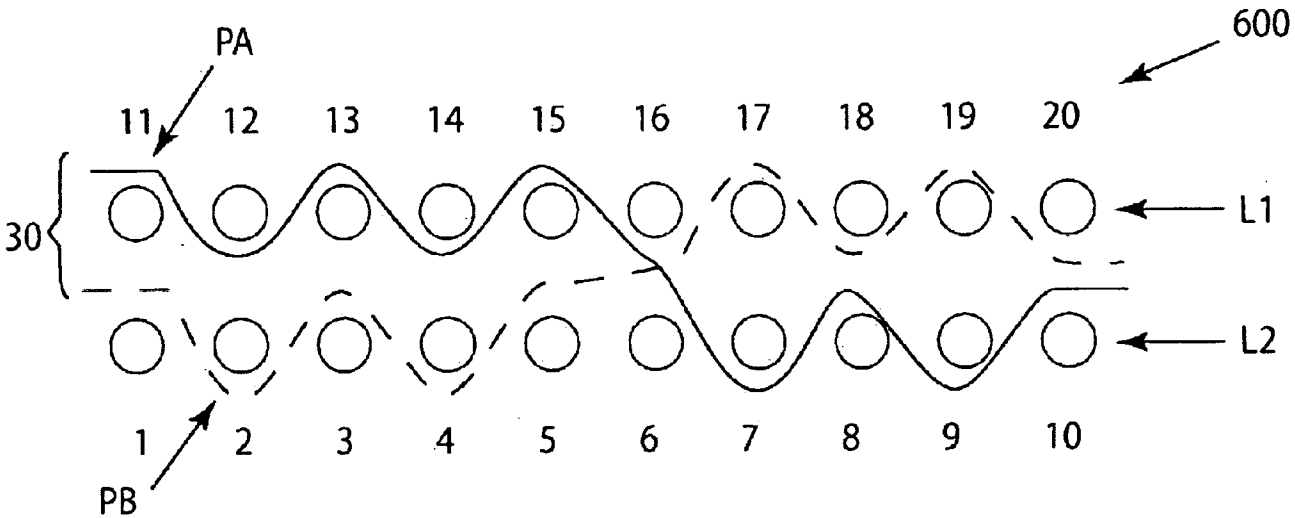
FIG. 17B illustrates a binder pair that may be used in a fabric with the binder pair of FIG. 17A.

Binder pair 630 can be implemented in a composite fabric interspersed with other binders, such as with binder pair 30 shown in FIG. 17B (which is the same as the binder pair shown in FIG. 1). For instance, considering the wear side view of FIG. 3, binder pair 630 can be interspersed such that the shown pattern from top to bottom changes from 50, 30, 50, 30, 50, 30, 50, 30, . . . to 50, 30, 50, 630, 50, 30, 50, 630, . . . . Alternatively, binder pair 630 can be used as the sole binder type of a fabric.

Figure 18A:
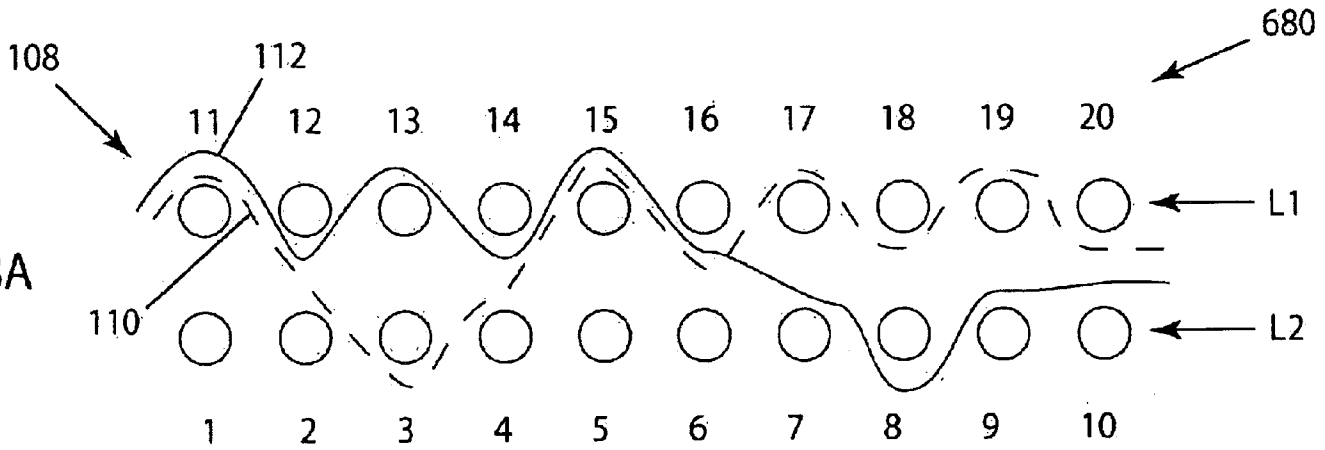
FIGS. 18A and 18B depict binder pairs that may be used in a fabric according to the present invention.
Figure 18B:
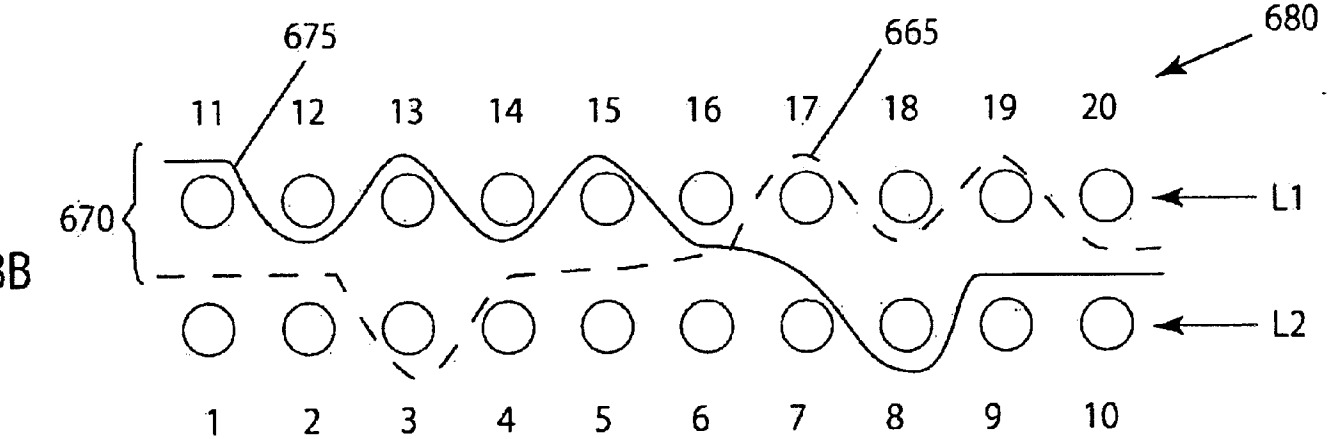

FIGS. 18A and 18B illustrate binder pairs, 108 and 670, respectively, that can be employed in another fabric 680 in accordance with the invention. Thus, binders 108 and 670 may be utilized interspersed with one another within fabric 680, e.g., alternatingly. Binder pair 108 is the same as that discussed earlier in connection with FIG. 12A; therefore, its description will not be repeated here. As shown in FIG. 18B, binder pair 670 contains yarns 665 and 675. In the repeat pattern shown, yarn 665 travels above yarns 1 and 2, then passes below warp yarn 3, travels above yarns 4, 5 and 6, and then interweaves top layer yarns 17–20 as shown. Yarn 675 interweaves yarns 11–15, then travels above yarns 6 and 7, contours below yarn 8, and travels above yarns 9 and 10 to complete the repeat pattern. The binder pairs 108 and 670 may be used within fabric 680 interspersed with weft yarns such as those shown in FIG. 2, or with those shown in FIG. 6, to form the composite fabric 680.

Figure 19:
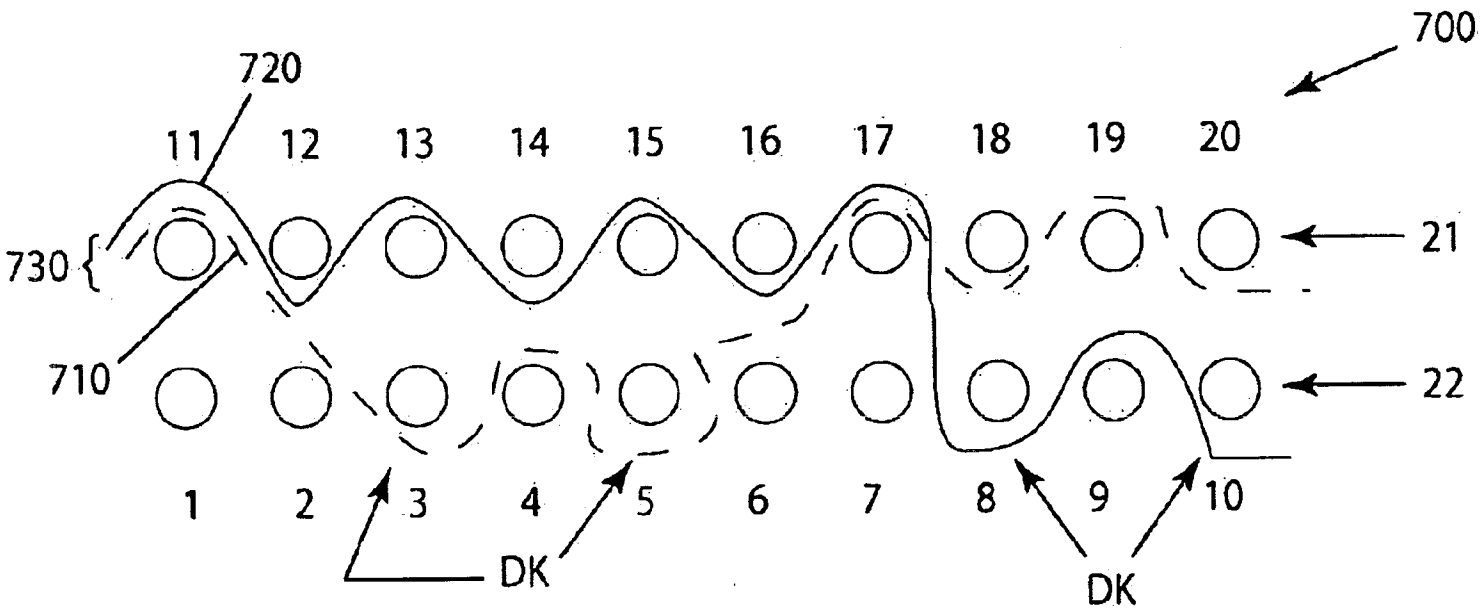
FIG. 19 illustrates a further binder pair embodiment of the present invention.

Referring now to FIG. 19, another binder pair, 730, in accordance with the invention is illustrated in a cross-sectional view, which forms a part of a composite fabric 700. Binder yarns 710 and 720 together comprise binder pair 730, which likewise binds together the yarns of paper side layer L1 and wear (machine) side layer L2. Binder pair 730 can also be considered to provide a combination of the double knuckle structure of the binder 30 described above and the DCP binders also described above. The shown pattern of binder pair 730 can be a repeat pattern which repeats in the CD direction. Yarn 710 forms a double knuckle DK around yarns 3 to 5, and this double knuckle affords the advantages mentioned earlier. Yarn 720 also forms a double knuckle DK, around warp yarns 8 and 10. Additionally, the co-location of binder yarns 710 and 720 at locations above warp yarns 11 and 17, for example, renders the binder pair a DCP-type binder with the attendant advantages. Note that yarn 720 drops sharply from above warp yarn 17 to below warp yarn 8, which results in a further minimization of the internal float of that binder yarn. As in the case of binder pair 630, binder pair 730 can be implemented in a composite fabric interspersed with other binders, such as with binder pair 30 of FIG. 1 (or 17B), or any of those shown in FIGS. 11 through 18. Alternatively, binder pair 730 can be utilized as the sole binder type of fabric 700. As in the cases above, the binder pair of FIG. 19 is employed interspersed with non-binder weft yarns (not shown) in fabric 700, such as those depicted in FIG. 2 or FIG. 6.

It is further noted that as a further variation to the embodiments described hereinabove, a number of the binder pairs within a fabric may be woven such that the two yarns within such pairs are arranged in the same side by side (or straight) manner for all such binder pairs. Additionally, a number of the binder pairs within the fabric may be woven such that the two yarns within such pairs are arranged in alternating or reverse side by side manner. As an example, in the above-described fabrics having SSB binder pairs, the SSB binder pairs may be arranged so as to be straight or reversed.

Furthermore, although embodiments of the present invention have been described as having a binding pair consists of CD yarns which pass over one or two MD yarns on an outer surface of the paper side layer, the present invention is not so limited. That is, other arrangements may also be utilized. For example, there may be CD yarns which pass over more than two MD yarns on an outer surface of the paper side layer within a repeat pattern. As another example, the binder pair may include two MD yarns which pass over one or more same CD yarns within a repeat pattern. As still another example, the binder yarns may pass over one or more same CD (or MD) yarns on an outer surface of the machine side layer within a repeat pattern.

Additionally, although the present invention has been described as usable for the papermaking process, the present invention is not so limited. That is, the present fabric may be utilized for other uses.

The fabric according to the present invention may comprise monofilament yarns. The CD yarns may be polyester monofilament and/or some may be polyester or polyamide. The CD and MD yarns may have a circular cross-sectional shape with one or more different diameters. Further, in addition to a circular cross-sectional shape, one or more of the yarns may have other cross-sectional shapes such as a rectangular cross-sectional shape, elliptical or another non-round cross-sectional shape.

It will be understood that the embodiments described above are merely exemplary and that one skilled in the art can make many variations to the disclosed embodiments without departing from the scope and sprit of the invention as defined by the appended claims.

What is claimed is:

1. A fabric comprising:

a first layer having machine direction (MD) yarns and cross-direction (CD) yarns interwoven therewith;

a second layer having machine direction (MD) yarns and cross-direction (CD) yarns interwoven therewith; and a plurality of pairs of first type of binder yarns for binding the first layer and the second layer together which are interwoven therewith so as to be (i) an integral part of the first layer and contribute to a structure thereof, and (ii) a non-integral part of the second layer and not contribute to a structure thereof, each first type pair having a first binder yarn and a second binder yarn;

wherein during a repeat pattern the first binder yarn of a first type pair is integrally woven with the yarns of the first layer and passes over outer surfaces of two non-consecutive yarns in the second layer.

2. The fabric according to claim 1, wherein the fabric is usable in at least one of a forming, pressing, and drying operation of a papermaking process.

3. The fabric according to claim 2, wherein the first layer is a paper side layer and the second layer is a machine side layer and wherein the first binder yarn passes over the outer surfaces of two non-consecutive yarns in the machine side layer.

4. The fabric according to claim 3, wherein the two non-consecutive yarns have only one yarn in the machine side layer therebetween in which the first binder yarn does not pass over the outer surface thereof.

5. The fabric according to claim 3, wherein during the repeat pattern the second binder yarn of the first type pair is integrally woven with the yarns of the first or paper side layer and passes over outer surfaces of two non-consecutive yarns in the second or machine side layer.

6. The fabric according to claim 5, wherein the first and second binder yarns of the first type pair together form a plain weave pattern on the top layer.

7. The fabric according to claim 2, wherein the first and second binder yarns are arranged so as to be substantially parallel to the CD yarns.

8. The fabric according to claim 2, wherein the first and second binder yarns are arranged so as to be substantially parallel to the MD yarns.

9. The fabric according to claim 2, wherein at least some of the MD and CD yarns are monofilament yarns.

10. The fabric according to claim 2, wherein at least some of the MD yarns are one of polyamide yarns or polyester yarns.

11. The fabric according to claim 2, wherein at least some of the CD yarns are one of polyamide yarns or polyester yarns.

12. The fabric according to claim 2, wherein at least some of the MD yarns and CD yarns have one of a circular cross-sectional shape, a rectangular cross-sectional shape and a non-round cross-sectional shape.

13. The fabric according to claim 2, further comprising a plurality of pairs of second type of binder yarns each having a first binder yarn and a second binder yarn for binding the first layer and the second layer together, and wherein said first and second binder yarns of at least one second type pair are interwoven with said first and second layers so as to pass over at least one common yarn on an outer surface of one of the first layer and the second layer.

14. The fabric according to claim 13, wherein the first layer is a paper side layer and wherein said first binder yarn and said second binder yarn of said at least one second type pair pass over two common yarns on the outer surface of said paper side layer within the repeat pattern.

15. The fabric according to claim 13, wherein the pairs of the first type of binder yarns and the pairs of the second type of binder yarns are arranged in an alternate manner such that a pair of a respective one of the first type of binder yarns is located between two pairs of the second type of binder yarns and a pair of a respective one of the second type of binder yarns is located between two pairs of the first type of binder yarns.

16. The fabric according to claim 15, wherein each of a number of the pairs of the first and second type of binder yarns are respectively located between two CD yarns such that a pair of the first type of binder yarns is located between two respective CD yarns one of which is located adjacent to a pair of the second type of binder yarns, which is located adjacent to another CD yarn, which is located adjacent to another pair of the first type of binder yarns, and so forth.

17. The fabric according to claim 2, wherein said first and second binder yarns of at least one first type pair are interwoven with said first and second layers so as to pass over at least one common yarn on an outer surface of one of the first layer and the second layer during the repeat pattern.

18. The fabric according to claim 17, wherein the first layer is a paper side layer and wherein said first binder yarn and said second binder yarn of said at least one first type pair pass over two common yarns on the outer surface of said paper side layer within the repeat pattern.

19. The fabric according to claim 2, wherein a pair of the first type binder yarns is effectively a CD yarn in the first layer and wherein the fabric has a shute ratio of 3:1 in which the shute ratio is a ratio of the number of the CD yarns and the effective CD yarn in the first layer to the number of CD yarns in the second layer.

20. A fabric for use in fabricating paper, said fabric comprising:

a first layer having machine direction (MD) yarns and cross-direction (CD) yarns interwoven therewith;

a second layer having machine direction (MD) yarns and cross-direction (CD) yarns interwoven therewith; and a plurality of binder yarns for binding the first layer and the second layer together which are interwoven therewith so as to be (i) an integral part of the first layer and contribute to a structure thereof, and (ii) a non-integral part of the second layer and not contribute to a structure thereof;

wherein at least one of the binder yarns is integrally woven with the yarns of the first fabric layer and passes over outer surfaces of two non-consecutive yarns in the second layer during a repeat pattern.

21. The fabric according to claim 20, wherein the first layer is a paper side layer and the second layer is a machine side layer, and wherein the at least one binder yarn passes over the outer surfaces of two non-consecutive yarns in the second or machine side layer during the repeat pattern.

22. The fabric according to claim 21, wherein the two non-consecutive yarns have only one yarn in the machine layer therebetween in which the at least one binder yarn does not pass over the outer surface thereof.

23. The fabric according to claim 20, wherein two binder yarns are interwoven with said first and second layers so as to pass over at least one common yarn on an outer surface of one of the first layer and the second layer during the repeat pattern.

24. The fabric according to claim 23, wherein the first layer is a paper side layer and wherein said two binder yarns pass over two common yarns on the outer surface of said paper side layer within the repeat pattern.

25. A fabric for use in fabricating paper, said fabric comprising:

a first layer having machine direction (MD) yarns and cross-direction (CD) yarns interwoven therewith;

a second layer having machine direction (MD) yarns and cross-direction (CD) yarns interwoven therewith; and a plurality of pairs of binder yarns for binding the first layer and the second layer together which are interwoven therewith so as to be (i) an integral part of the first layer and contribute to a structure thereof, and (ii) a non-integral part of the second layer and not contribute to a structure thereof, each pair having a first binder yarn and a second binder yarn;

wherein the first binder yarn of a pair passes in-between only two consecutive first layer yarns and two consecutive second layer yarns at a given location within a repeat pattern, and wherein the second binder yarn of the pair passes in-between only one first layer yarn and one second layer yarn at a given location within the repeat pattern.

26. The fabric according to claim 25, wherein the first and second binder yarns of a pair cross one another while passing in-between the top and bottom layer yarns.

27. The fabric according to claim 26, wherein the first layer is a paper side layer and the second layer is a machine side layer.

* * * * *